US009381571B2

(12) United States Patent
Copland et al.

(10) Patent No.: US 9,381,571 B2
(45) **Date of Patent: *Jul. 5, 2016**

(54) HEARTH

(71) Applicant: ATI Properties, Inc., Albany, OR (US)

(72) Inventors: Evan H. Copland, Sydney (AU); Matthew J. Arnold, Charlotte, NC (US); Ramesh S. Minisandram, Charlotte, NC (US)

(73) Assignee: ATI PROPERTIES, INC., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/961,272

(22) Filed: Dec. 7, 2015

(65) Prior Publication Data

US 2016/0082508 A1 Mar. 24, 2016

Related U.S. Application Data

(63) Continuation of application No. 14/639,193, filed on Mar. 5, 2015, now Pat. No. 9,205,489, which is a continuation of application No. 13/759,370, filed on Feb. 5, 2013, now Pat. No. 9,050,650.

(51) Int. Cl.
*B22D 11/103* (2006.01)
*B22C 9/08* (2006.01)
(Continued)

(52) U.S. Cl.
CPC . *B22D 41/00* (2013.01); *B22C 9/08* (2013.01); *B22D 11/0403* (2013.01);
(Continued)

(58) Field of Classification Search
CPC ..... B22D 27/02; B22D 11/116; B22C 9/08
USPC ..... 164/266, 335, 337, 453, 469, 470, 494, 164/495, 506, 508, 509
See application file for complete search history.

(56) References Cited

U.S. PATENT DOCUMENTS 2,816,828 A * 12/1957 Benedict ..... C22B 34/1272 164/475
3,342,250 A * 9/1967 Treppschuh ..... B22D 11/00 164/258

(Continued)

FOREIGN PATENT DOCUMENTS

EP 0124667 A2 11/1984
EP 0896197 A1 2/1999

(Continued)

OTHER PUBLICATIONS

Bakish, R., "The State of the art in Electron Beam Melting and Refining", JOM, Springer, New York LLC, United States, vol. 43(5), May 1, 1991, pp. 42-44.
Definition of hearth, http://www.thefreedictionary.com/hearth, 1991.
Fluid Dynamics, http://francesca.phy.cmich.edu/people/andy/physics110/book/Chapters/Chapters9.htm, date unknown, 10 pages.
English translation of non-patent literature of a third party submission of relevant art, Jun. 17, 2015, 14 pages.

*Primary Examiner* — Kevin E Yoon
(74) *Attorney, Agent, or Firm* — K&L Gates LLP

(57) ABSTRACT

A casting system and method. The casting system can include an energy source and a hearth, which can have a tapered cavity. The tapered cavity can have a first end portion and a second end portion, and the tapered cavity can narrow between the first and second end portions. Further, the tapered cavity can have an inlet at the first end portion that defines an inlet capacity, and one or more outlets at the second end portion that define an outlet capacity. Where the cavity has a single outlet, the outlet capacity can be less than the inlet capacity. Where the cavity has multiple outlets, the combined outlet capacity can match the inlet capacity. Further, the cross-sectional area of the tapered cavity near the inlet can be similar to the cross-sectional area of the inlet.

20 Claims, 14 Drawing Sheets

(51) Int. Cl.

| | |
|---|---|
| ***B22D 41/00*** | (2006.01) |
| ***B22D 11/04*** | (2006.01) |
| ***B22D 11/116*** | (2006.01) |
| ***F27B 3/10*** | (2006.01) |
| ***F27B 3/12*** | (2006.01) |
| ***F27B 3/18*** | (2006.01) |
| ***F27B 3/19*** | (2006.01) |
| ***F27D 3/14*** | (2006.01) |
| ***B22D 35/04*** | (2006.01) |
| ***F27B 3/14*** | (2006.01) |
| ***F27B 3/24*** | (2006.01) |
| ***F27D 9/00*** | (2006.01) |

(52) U.S. Cl.

CPC ..... *B22D 11/103* (2013.01); *B22D 11/116* (2013.01); *B22D 35/04* (2013.01); *F27B 3/10* (2013.01); *F27B 3/12* (2013.01); *F27B 3/14* (2013.01); *F27B 3/18* (2013.01); *F27B 3/19* (2013.01); *F27B 3/24* (2013.01); *F27D 3/14* (2013.01); *F27D 9/00* (2013.01); *F27D 2009/0002* (2013.01)

(56) References Cited

U.S. PATENT DOCUMENTS

| | | | | | |
|---|---|---|---|---|---|
| 3,343,828 | A * | 9/1967 | Hunt | C22B 9/228 | 219/121.16 |
| 3,549,140 | A * | 12/1970 | Ingersoll | C22B 34/1272 | 239/422 |
| 3,658,119 | A * | 4/1972 | Hunt | B22D 11/113 | 164/258 |
| 4,027,722 | A * | 6/1977 | Hunt | B22D 11/113 | 164/133 |
| 4,190,404 | A * | 2/1980 | Drs | C22B 9/228 | 164/134 |
| 4,372,542 | A * | 2/1983 | Chia | B22D 43/00 | 266/229 |
| 4,376,649 | A * | 3/1983 | Schwartz | C22B 13/08 | 75/696 |
| 4,750,542 | A * | 6/1988 | Harker | C22B 9/228 | 164/506 |
| 4,823,358 | A * | 4/1989 | Aguirre | H01J 37/305 | 164/506 |
| RE32,932 | E * | 5/1989 | Harker | C22B 9/228 | 164/506 |
| 4,838,340 | A * | 6/1989 | Entrekin | B22D 11/11 | 164/154.5 |
| 4,839,904 | A * | 6/1989 | Harberts | C22B 9/228 | 373/10 |
| 4,932,635 | A * | 6/1990 | Harker | B22D 11/11 | 266/200 |
| 4,936,375 | A * | 6/1990 | Harker | B22D 11/10 | 164/420 |
| 4,961,776 | A * | 10/1990 | Harker | B22D 11/11 | 266/214 |
| 5,040,773 | A * | 8/1991 | Hackman | B22D 41/60 | 222/592 |
| 5,084,090 | A * | 1/1992 | Harker | C22B 9/22 | 373/12 |
| 5,171,357 | A * | 12/1992 | Aguirre | C22B 4/00 | 75/10.19 |
| 5,171,358 | A * | 12/1992 | Mourer | B22F 9/08 | 266/227 |
| 5,222,547 | A * | 6/1993 | Harker | C22B 9/228 | 164/469 |
| 5,224,534 | A * | 7/1993 | Shimizu | B22D 23/06 | 164/469 |
| 5,263,689 | A * | 11/1993 | Menzies | B22F 9/08 | 266/202 |
| 5,273,101 | A * | 12/1993 | Lillquist | B22D 23/06 | 164/452 |
| 5,291,940 | A * | 3/1994 | Borofka | B22D 5/04 | 164/122.1 |
| 5,454,424 | A * | 10/1995 | Mori | B22D 11/11 | 164/469 |
| 5,503,655 | A * | 4/1996 | Joseph | C22B 7/04 | 75/10.19 |
| 5,516,081 | A * | 5/1996 | Mourer | C22B 9/226 | 266/233 |
| 5,972,282 | A * | 10/1999 | Aguirre | B22D 11/11 | 266/207 |
| 6,264,884 | B1 * | 7/2001 | Grosse | C22B 34/1295 | 266/241 |
| 6,561,259 | B2 * | 5/2003 | Spadafora | B22D 11/001 | 164/437 |
| 6,824,585 | B2 * | 11/2004 | Joseph | C22B 4/005 | 420/590 |
| 6,868,896 | B2 | 3/2005 | Jackson et al. | | |
| 7,137,436 | B2 | 11/2006 | Jackson et al. | | |
| 9,050,650 | B2 * | 6/2015 | Copland | B22D 11/0403 | 164/266 |
| 9,205,489 | B2 * | 12/2015 | Copland | B22D 11/0403 | 164/266 |
| 9,221,097 | B2 | 12/2015 | Copland et al. | | |
| 2002/0104596 | A1 | 8/2002 | Crafton et al. | | |
| 2012/0255701 | A1 * | 10/2012 | Moxley | F27B 3/04 | 164/494 |
| 2013/0327493 | A1 * | 12/2013 | Oda | B22D 11/124 | 164/512 |
| 2014/0090792 | A1 | 4/2014 | Arnold | | |

FOREIGN PATENT DOCUMENTS

| | | | | |
|---|---|---|---|---|
| GB | 2178352 | A * | 2/1987 | B22D 11/14 |
| GB | 2207225 | A * | 1/1989 | C22B 9/228 |
| JP | 57-202483 | | 12/1982 | |
| JP | 63273555 | A * | 11/1988 | |
| JP | 07252544 | A * | 10/1995 | |
| WO | WO 9000627 | A1 * | 1/1990 | B22D 11/11 |
| WO | WO 9749266 | A1 * | 12/1997 | B22D 43/008 |
| WO | WO 0118271 | A1 * | 3/2001 | C22B 9/228 |
| WO | WO 2004/058431 | A2 | 7/2004 | |
| WO | WO 2007093135 | A1 * | 8/2007 | C22B 4/08 |

* cited by examiner

HEARTH

CROSS-REFERENCE TO RELATED APPLICATIONS

This patent application is a continuation application claiming priority under 35 U.S.C. §120 to co-pending U.S. patent application Ser. No. 14/639,193, filed on Mar. 5, 2015, which in turn is a continuation application claiming priority under 35 U.S.C. §120 to U.S. patent application Ser. No. 13/759,370, filed on Feb. 5, 2013, issued as U.S. Pat. No. 9,050,650, all of which are hereby incorporated herein by reference in their entirety.

FIELD OF TECHNOLOGY

The present disclosure generally relates to systems, methods, tools, techniques, and strategies for casting molten material.

BACKGROUND

The casting of certain ingots of, for example, titanium alloys and certain other high performance alloys, may be both expensive and procedurally difficult given the extreme conditions present during production and the nature of the materials included in the alloys. For example, in many currently available cold hearth casting systems, such as plasma arc melting in an inert atmosphere or electron beam melting within a vacuum melt chamber, the casting system can be used to melt and mix various recycled scrap, master alloys, and various other starting materials to produce the desired alloy. The casting systems utilize starting materials that can contain high density and/or low density inclusions, which in turn can lead to a lower quality and potentially unusable heat or ingot. Cast material considered unusable oftentimes can be melted down and reused, but such material typically would be considered of lesser quality and command a lower price in the marketplace. During casting operations, producers generally desire to remove inclusions from the molten material prior to directing the molten material into the casting mold.

To vaporize, dissolve, or melt inclusions in molten material, an energy source in the casting system, such as an electron beam gun or plasma torch, for example, can apply energy to the surface of molten material in a hearth of the casting system. The energy produced by the energy source can be sufficient to vaporize or melt the inclusions. However, during casting operations, a dynamic flow path can develop in the hearth of the casting system, and less dynamic regions, i.e., stagnant zones or pools, can form adjacent to, around, and/or near the dynamic flow path. Without adequate mixing, molten material can rest in a stagnant zone, and thus remain in the hearth, for a longer period of time than the molten material flowing along the dynamic flow path. In other words, the residence time of molten material in the hearth can depend on whether the molten material flows along the dynamic flow path or rests in a stagnant zone, and thus, the residence time of molten material in the hearth can be inconsistent. Furthermore, the molten material in stagnant zones can be subjected to the energy produced by the energy source for a longer period of time than the molten material in the dynamic flow path. As a result, the elemental depletion of molten material having a longer residency time in the hearth, i.e., molten material that rests in a stagnant zone, can be greater than the elemental depletion of molten material having a shorter residency time in the hearth, i.e., molten material that flows along the dynamic flow path. When the molten material in the hearth has different chemical compositions throughout, the resulting cast alloy can have compositional variances.

Furthermore, in casting systems that utilize multiple casting molds extending from a single hearth, the formation of stagnant zones can divert and/or alter the desired flow of molten material into the casting molds. In other words, the casting rates can vary between the casting molds of the casting system.

Accordingly, it would be advantageous to provide a casting system that is less susceptible to the formation of stagnant zones in the hearth thereof. Further, it would be advantageous to provide a casting system that produces a more compositionally uniform cast alloy. Additionally, it would be advantageous to provide a casting system that promotes identical or similar casting rates across multiple casting molds. More generally, it would be advantageous to provide an improved casting system that is useful for titanium, other high performance alloys, and metals and metal alloys generally.

SUMMARY

An aspect of the present disclosure is directed to a non-limiting embodiment of a casting system which can comprise a hearth and a plurality of molds. The hearth can comprise an inlet defining an inlet cross-sectional area and a plurality of outlets, wherein each outlet defines an outlet cross-sectional area. The hearth can also comprise a cavity between the inlet and the plurality of outlets, wherein the cavity tapers from the inlet toward the plurality of outlets. A mold can be aligned with each outlet of the hearth.

Another aspect of the present disclosure is directed to a non-limiting embodiment of a hearth for use with a casting system, wherein the hearth can comprise a cavity comprising a first end portion and a second end portion, wherein the cavity narrows between the first end portion and the second end portion. The hearth can further comprise an inlet at the first end portion, wherein the inlet defines an inlet capacity. The hearth can also comprise an outlet at the second end portion, wherein the outlet defines an outlet capacity.

Another aspect of the present disclosure is directed to a non-limiting embodiment of a hearth for use with a casting system, wherein the hearth can comprise a carrying means for carrying molten material. The carrying means can comprise a receiving means for receiving molten material, wherein the receiving means comprises a receiving capacity. Further, the carrying means can comprise a delivering means for delivering molten material, wherein the delivering means comprises a delivering capacity, and wherein the delivering capacity substantially equals the receiving capacity. The hearth can also comprise a narrowing means for narrowing the carrying means between the receiving means and the delivering means.

Yet another aspect of the present disclosure is directed to a non-limiting embodiment of a casting system can comprise a hearth structured to receive material and an energy source structured to energize material in the hearth, wherein a portion of the material can form a skull of material in the hearth. The skull of material can comprise an inlet defining an inlet cross-sectional area, an outlet defining an outlet cross-sectional area, and a cavity between the inlet and the outlet, wherein the cavity tapers from the inlet toward the outlet.

Another aspect of the present disclosure is directed to a non-limiting embodiment of a method for casting material. The method can comprise passing a molten material through an inlet of a hearth, wherein the inlet comprises an inlet capacity; passing the molten material through a tapered cavity of the hearth; passing the molten material through a plurality of outlets of the hearth, wherein each outlet comprises an outlet capacity, and wherein the sum of the outlet capacities substantially matches the inlet capacity; and passing the molten material into a plurality of molds.

Still another aspect of the present disclosure is directed to a non-limiting embodiment of a method for casting material. The method can comprise passing a molten material into a hearth through an inlet; selectively applying energy to the molten material in the hearth to form a skull of material in the hearth, wherein the skull of material defines a cavity; passing the molten material through an outlet of the hearth, wherein the cavity tapers from the inlet to the outlet; and passing the molten material into a mold.

BRIEF DESCRIPTION OF THE FIGURES

The features and advantages of the present invention may be better understood by reference to the accompanying figures in which.

DETAILED DESCRIPTION

Figure 1:
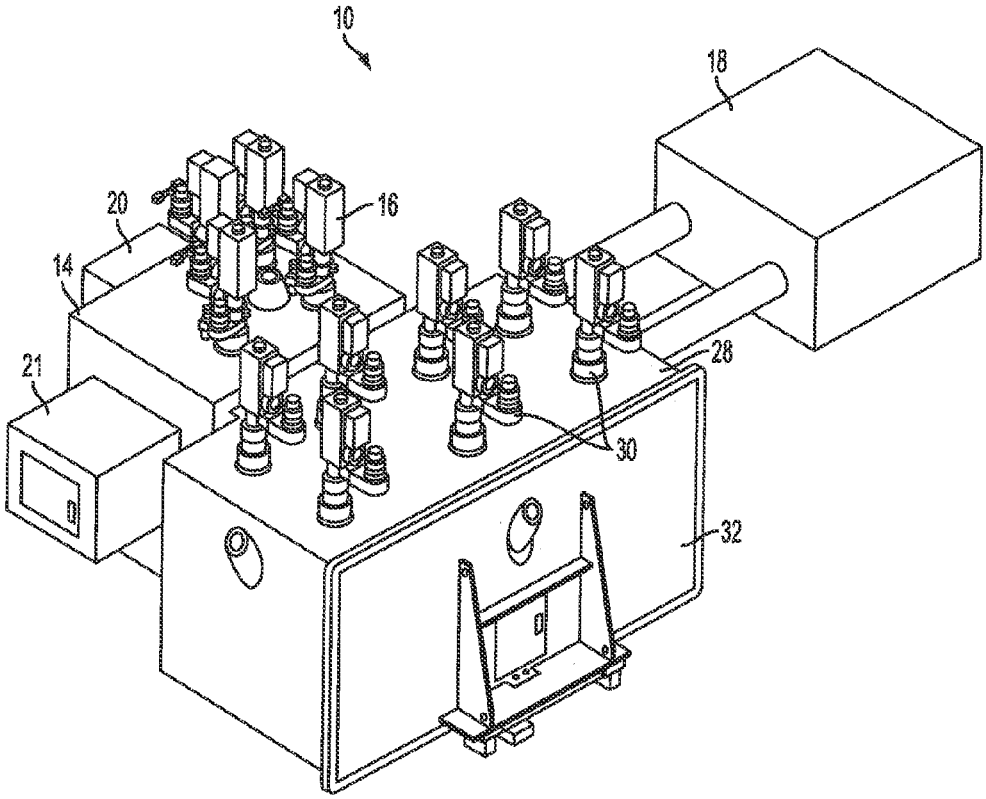
FIG. 1 is a schematic depiction of a casting system according to at least one non-limiting embodiment of the present disclosure.

The following non-limiting embodiments of casting systems according to the present disclosure described below and illustrated in certain of the accompanying figures incorporate one or more electron beam guns; however, it will be understood that other melting power sources could be used in the casting systems as material heating devices. For example, the present disclosure also contemplates a casting system using one or more plasma generating devices that generate energetic plasma and heat metallic material within the casting system by contacting the material with the generated plasma.

Cold hearth casting systems, such as electron beam melting within a vacuum melt chamber, typically utilize a copper hearth incorporating a fluid-based cooling system to limit the temperature of the hearth to temperatures below the melting temperature of the copper material. Although water-based cooling systems are the most common, other systems, such as argon-based or molten salt cooling systems, may be incorporated into a cold hearth. Cold hearth systems, at least in part, use gravity to refine molten metallic material by removing inclusions from the molten material resident within the hearth. Relatively low density inclusions float for a time on the top of the molten material as the material is mixed and flows within the cold hearth, and the exposed inclusions may be remelted or vaporized by one or more of the casting system's electron beam guns. Relatively high density inclusions sink to the bottom of the molten material and deposit close to the copper hearth. As molten material in contact with the cold hearth is cooled through action of the hearth's fluid-based cooling system, the materials freeze to form a solid coating or "skull" on the bottom and/or side surfaces of the hearth. The skull protects the surfaces of the hearth from molten material within the hearth. Entrapment of inclusions within the skull removes the inclusions from the molten material, resulting in a higher purity casting.

The melting hearth of an electron beam casting system can fluidly communicate with a refining hearth of the casting system via a molten material flow path. Starting materials can be introduced into the melting chamber and the melting hearth therein, and one or more electron beams impinge on and heat the materials to their melting points. To allow for proper operation of the one or more electron beam guns, at least one vacuum generator can be associated with the melting chamber and can provide vacuum conditions within the chamber. In certain non-limiting embodiments, an intake area can also be associated with the melting chamber, through which starting materials may be introduced into the melting chamber and can be melted and initially disposed within the melting hearth. The intake area can include, for example, a conveyer system for transporting materials to the melting hearth. Starting materials that are introduced into the melting chamber of a casting system can be in a number of forms such as, for example, loose particulate material (e.g., sponge, chips, and master alloy), compacted material in the form of briquettes (e.g., compacted sponge, chips, and master alloy), or a bulk solid that has been welded into a bar or other suitable shape. Accordingly, the intake area can be designed to handle the particular starting materials expected to be utilized by the casting system.

Once the starting materials are melted in the melting hearth, the molten material can remain in the melting hearth for a period of time to better ensure complete melting and homogeneity. The molten material can move from the melting hearth to the refining hearth via a molten material pathway. In various non-limiting embodiments, the molten material can flow through various intermediate hearths between the melting hearth and the refining hearth, for example. The refining hearth can be within the melting chamber or another vacuum enclosure and can be maintained under vacuum conditions by the vacuum system to allow for proper operation of one or more electron beam guns associated with the refining hearth. While gravity-based movement mechanisms can be used, mechanical movement mechanisms can also be used to aid in the transport of the molten material from the melting hearth to the refining hearth. Once the molten material is disposed in the refining hearth, the material can be subjected to continuous heating at suitably high temperatures by at least one electron beam gun for a sufficient time to acceptably refine the material. The one or more electron beam guns, again, can be of sufficient power to maintain the material in a molten state in the refining hearth, and also can be of sufficient power to vaporize or melt inclusions that appear on the surface of the molten material. Furthermore, in certain non-limiting embodiments, the casting system can include multiple refining hearths through which the molten material can flow.

The molten material can be retained in the refining hearth for sufficient time to remove inclusions therefrom and otherwise refine the material. Relatively long or short residence times within the refining hearth may be selected depending on, for example, the composition and the prevalence of inclusions in the molten material. Those having ordinary skill may readily ascertain suitable residence times to provide appropriate refinement of the molten material during casting operations. Preferably, the refining hearth can be a cold hearth, and inclusions in the molten material can be removed by processes including dissolution in the molten material, by falling to the bottom of the hearth and becoming entrapped in the skull, and/or by being vaporized by the action of the electron beams focused on the surface of the molten material. In certain embodiments, the electron beams directed toward the refining hearth can be rastered across the surface of the molten material in a predetermined pattern to create a mixing action. One or more mechanical movement devices can be provided to provide a mixing action or to supplement the mixing action generated by the rastering of the electron beams.

Once suitably refined, the molten material can pass via gravity and/or by mechanical means along the molten material pathway from the refining hearth to a casting mold. The molten material can flow through a casting port in the casting chamber to pass into the casting mold. In various non-limiting embodiments, the molten material can flow through various intermediate hearths between the refining hearth and the casting mold, for example. The molten material can remain in the casting mold until the molten material is substantially cooled to retain its shape. In at least one non-limiting embodiment, the mold can be an open-bottomed mold such that cast material can exit the bottom of the mold during the casting operation. For example, the casting system can be a continuous casting system, as described in U.S. patent application Ser. No. 13/629,696, or a semi-continuous casting system, as described in U.S. Patent Application Publication No. 2012/0255701 to Moxley et al., the entire disclosures of which are incorporated by reference herein. For example, the continuous casting system can provide a withdrawal mechanism that continuously withdraws cast material through the open bottom of a casting mold. Further, in various non-limiting embodiments, the refining hearth can simultaneously feed molten material into a plurality of casting molds. For example, the refining hearth can feed molten material into two or more parallel-filling, identical casting molds.

Figure 2:
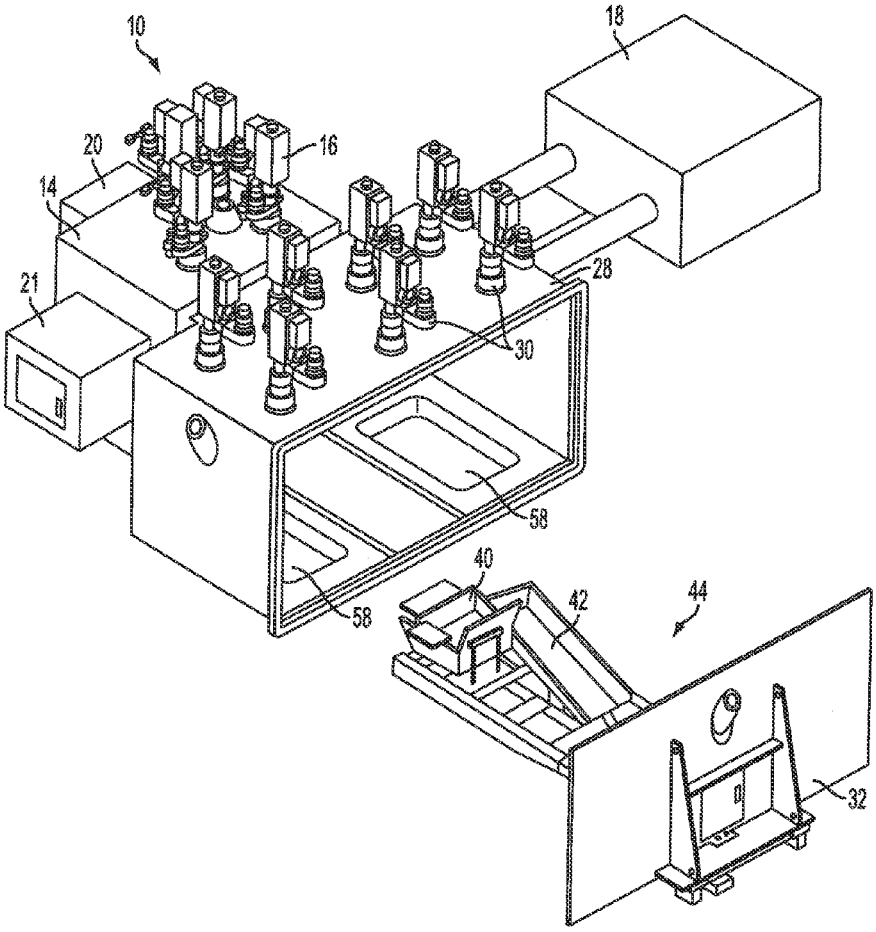
FIG. 2 is a schematic depiction of the casting system shown in FIG. 1, wherein a wall of the casting chamber has been moved away from the casting chamber to expose an interior of the casting chamber, according to at least one non-limiting embodiment of the present disclosure.

The arrangement of elements described above may be better understood by reference to FIGS. 1 and 2, which schematically depict a non-limiting embodiment of a casting system 10 according to the present disclosure. Referring to FIG. 1, the casting system 10 includes a melting chamber 14, which can receive material therein for melting. A plurality of melting power sources, such as electron beam guns 16, for example, extend into the melting chamber 14, and can operably provide energy to the starting material positioned therein. For example, the melting power sources can produce a high intensity electron beam across the surface of the starting material to melt the material in the melting chamber 14. A vacuum generator 18 is associated with the melting chamber 14. Starting materials, which may be in the form of, for example, scrap material, bulk solids, master alloys, and powders, can be introduced into melting chamber 14 through one or more intake areas providing access to the interior of the melting chamber 14. For example, as shown in FIGS. 1 and 2, each of the intake chambers 20 and 21 includes an access hatch that communicates with the interior of melting chamber 14. In certain non-limiting embodiments of the casting system 10, the intake chamber 20 may be suitably adapted to allow introduction of particulate and powdered starting material into melting chamber 14, for example, and the intake chamber 21 may be suitably adapted to allow introduction of bar-shaped and other bulk solid starting material into melting chamber 14, for example.

Referring still to FIGS. 1 and 2, in various non-limiting embodiments, the casting chamber 28 is positioned adjacent to the melting chamber 14. Several power sources, such as additional electron beam guns 30, extend into the casting chamber 28, and can operably direct energy into the interior of the casting chamber 28 to maintain the material in the molten state and/or to purify the molten material therein. As shown in FIG. 2, a translatable side wall 32 of the casting chamber 28 can be detached from the casting chamber 28 and moved away from the casting system 10, exposing the interior of the casting chamber 28. A melting hearth 40, a refining hearth 42, and a receiving receptacle 44 can be connected to the translatable side wall 32 and, thus, the entire assemblage of the translatable side wall 32, the melting hearth 40, the refining hearth 42, and the receiving receptacle 44 can be moved away from the casting system 10, exposing the interior of the casting chamber 28. The translatable side wall 32 may be moved away from the casting chamber 28 to allow access to any of the melting hearth 40, the refining hearth 42, and the receiving receptacle 44, for example, and to access the interior of the casting chamber 28. Also, in various non-limiting embodiments, after one or more casting runs, a particular assemblage of a translatable side wall, a melting hearth, a refining hearth, and a receiving receptacle may be replaced with a different assemblage of those elements. Molten material can flow from the receiving receptacle 44 into one or more casting molds. For example, as described in U.S. Patent Application Publication No. 2012/0255701 to Moxley et al., the entire disclosure of which is incorporated by reference herein, molten material can flow into one or the other of two casting molds positioned on opposed sides of the receiving receptacle 44. As described in U.S. Patent No. 2012/0255701 to Moxley et al., the casting system 10 can be constructed so that molten material flows only along one desired flow path to either one or the other casting molds at a time, and can alternate or switch between the casting molds. Further, in various non-limiting embodiments, the arrangement and use of an energy source, such as electron beam guns, can control the flow of molten material along the desired flow path and into the desired casting mold. Further, in certain non-limiting embodiments, the casting system can include additional hearths and/or receiving receptacles. In various non-limiting embodiments, instead of moving through a receiving receptacle 44, molten material can move directly from the refining hearth 42 into a casting mold.

Figure 3:
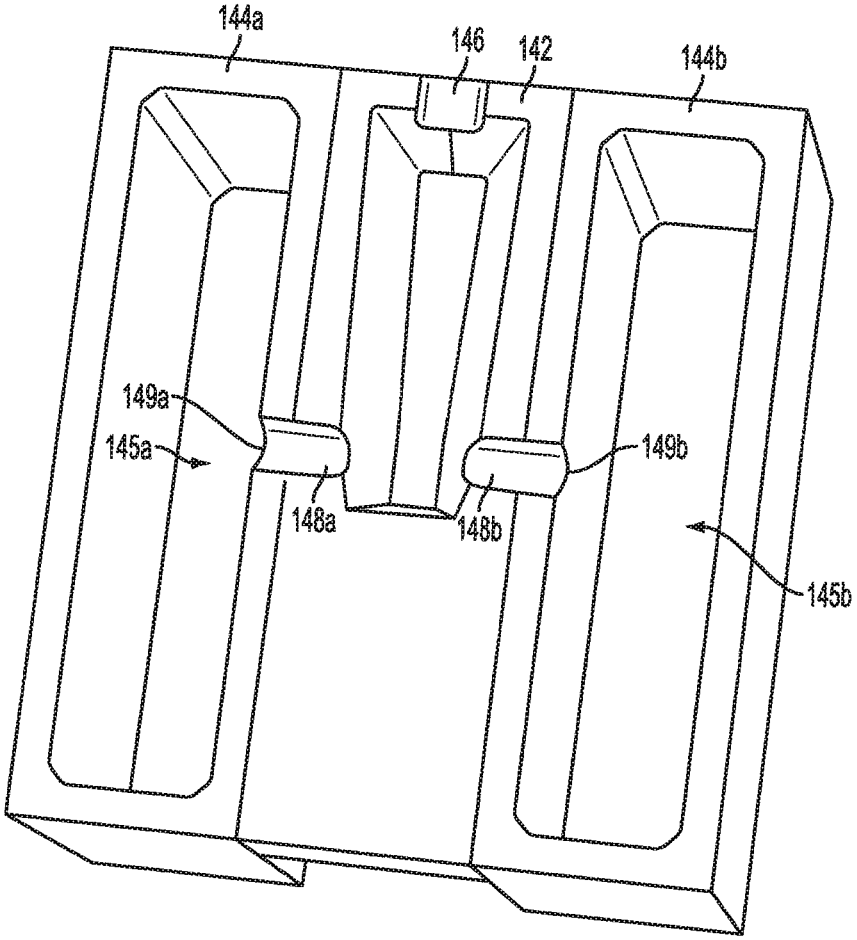
FIG. 3 is a perspective view of a hearth and parallel molds according to at least one non-limiting embodiment of the present disclosure.

Referring now to FIG. 3, a refining hearth 142 can be disposed within the casting chamber 28 (FIGS. 1 and 2). In various non-limiting embodiments, the refining hearth 142 can be positioned adjacent to the casting molds 144*a*, 144*b*, and the refining hearth 142 can direct the molten material into the molds 144*a*, 144*b*. In certain non-limiting embodiments, the casting chamber 28 can include a plurality of molds 144*a*, 144*b*, which can be symmetrically arranged on either side of the refining hearth 142, for example, and the refining hearth 142 can direct the molten material into the molds 144*a*, 144*b*. For example, the refining hearth 142 can have multiple outlets 148*a*, 148*b* and/or multiple pour lips 149*a*, 149*b*, and each outlet 148*a*, 148*b* can be aligned with a mold 144*a*, 144*b* and/or a mold inlet. In certain non-limiting embodiments, molten material can flow into the refining hearth 142 and can exit through outlets 148*a*, 148*b* to flow into the molds 144*a*, 144*b*. In other words, the molds 144*a*, 144*b* can be concurrently filled with molten material.

In various non-limiting embodiments, where the casting system 10 (FIGS. 1 and 2) is configured for continuous or semi-continuous casting, cast material can be concurrently withdrawn through the open-bottoms 145*a*, 145*b* of the molds 144*a*, 144*b* as molten material is directed into the mold 144*a*, 144*b*. For example, the cast ingot can be withdrawn from the open-bottomed molds 144*a*, 144*b* at a rate related to the rate molten material enters the molds 144*a*, 144*b* from the corresponding outlets 148*a*, 148*b* of the refining hearth 142. The cast ingot can be withdrawn at such a rate that the molten material in each mold 144*a*, 144*b* remains below the pour lip 149*a*, 149*b* of the corresponding outlet 148*a*, 148*b*, for example. In various non-limiting embodiments, the open-bottoms 145*a*, 145*b* of the casting molds 144*a*, 144*b* can be aligned with the casting ports 58 of the casting chamber 28 (FIGS. 1 and 2), and the cast material can exit the casting chamber 28 through a casting port 58. In certain non-limiting embodiments, the casting system 10 can include additional molds and/or the refining hearth 142 can include additional outlets. For example, the casting system 10 can include four molds and the refining hearth can include four outlets. In certain non-limiting embodiments, the casting system 10 can include three or more molds and the refining hearth can include three or more outlets, for example. In various non-limiting embodiments, the number of molds of the casting system can correspond to the number of refining hearth outlets, and, in at least one embodiment, the multiple molds can be symmetrically arranged relative to the refining hearth. In certain non-limiting embodiments, a single mold can extend from the refining hearth.

As described herein, the molds 144*a*, 144*b* can be open-bottomed molds such that cast material can exit the open-bottom 145*a*, 145*b* of the mold 144*a*, 144*b* during continuous casting operations, for example. Further, the molds 144*a*, 144*b* can have an inner perimeter that corresponds to the intended shape of the cast material. A circular inner perimeter can produce a cylinder, for example, and a rectangular inner perimeter can produce a rectangular prism, for example. In various non-limiting embodiments, the molds 144*a*, 144*b* can have circular inner perimeter having a diameter of approximately 6 inches to approximately 32 inches, for example. Further, in certain non-limiting embodiments, the molds 144*a*, 144*b* can have a rectangular inner perimeter that is approximately 36 inches by approximately 54 inches, for example. In at least one non-limiting embodiment, the molds 144*a*, 144*b* can have a cross-sectional area that is less than approximately 28 square inches' or greater than approximately 2,000 square inches, for example.

As described herein, inclusions in the molten material in the refining hearth 142 can be removed by processes including, for example, dissolution in the molten material, by falling to the bottom of the hearth 142 and becoming entrapped in the skull, and/or by being vaporized by the action of the electron beams generated by the electron beams guns 30 (FIGS. 1 and 2) focused on the surface of the molten material. In the refining hearth 142, a dynamic flow path can develop, and less dynamic regions, i.e., stagnant zones or pools, can develop adjacent to, near, and/or around the dynamic flow path. Without adequate mixing, molten material can rest in a stagnant zone in the refining hearth 142 for an extended period of time, and thus remain in the refining hearth for a relatively longer period of time, while molten material in the dynamic flow path can move through the refining hearth 142 more quickly. As described herein, molten material retained in a stagnant zone can be subjected to the electron beams for a longer period of time than molten material in the dynamic flow path, which can result in comparatively more elemental depletion in the stagnant zones and comparatively less elemental depletion in the dynamic flow path. As noted above, it is contemplated that various melting power sources such as, for example, electron beam guns 30 (FIGS. 1 and 2) and/or plasma generating devices, could be used in the casting system 10 as material heating devices to heat and/or refine the metallic material.

According to the present disclosure, the geometry of a refining hearth 142 can be designed and/or selected to reduce the formation of stagnant zones therein, and thus, improve the chemical uniformity of molten material passing therethrough. For example, referring to FIG. 3, the refining hearth 142 can taper and/or narrow between an inlet 146 and the outlets 148*a*, 148*b* thereof. In other words, the cross-sectional area of the refining hearth 142 (a cross-section taken transverse to the flow axis of the hearth 142, i.e., transverse to the direction of molten material flow) can decrease along the flow axis of the hearth 142. Stated differently, the refining hearth 142 can be wider at and/or near the inlet 146 and narrower at and/or near the outlets 148*a*, 148*b*. To maintain a constant or substantially constant mass flow through the tapered hearth 142, for example, the velocity of molten material flowing therethrough can increase between the inlet 146 and the outlets 148*a*, 148*b* thereof.

The improved geometry of the refining hearth 142 can increase the velocity of molten material flowing therethrough and can reduce the pressure in the molten material. Stated differently, to maintain a constant or substantially constant mass flow through the tapered hearth 142, for example, the velocity of the molten material can increase from the inlet 146 to the outlet 148, and the pressure in the molten material can correspondingly decrease from the inlet 146 to the outlet 148. Furthermore, the improved geometry of the refining hearth 142 can provide a more direct flow path for the molten material, which can reduce and/or limit the formation of stagnant zones in the molten material. An improved molten material flow path with reduced stagnant zones can promote a more uniform residence time in the hearth. The defined residence time can be controlled to sufficiently vaporize the inclusions in the molten material while limiting and/or preventing excessive elemental depletion therein. Additionally, during continuous casting operations of multiple molds, the improved molten material flow path can promote identical or similar casting rates in the various casting molds.

Additionally or alternatively, in various embodiments, the inlet 146 of the refining hearth 142 can comprise an inlet cross-sectional area (a cross-section taken transverse to the flow axis of the hearth 142), and the outlets 148*a*, 148*b* can comprise outlet cross-sectional areas (cross-sections taken transverse to the flow axis of the hearth 142) that may be totaled to provide a combined outlet cross-sectional area. The combined outlet cross-sectional area can match or be similar to the inlet cross-sectional area, for example. In certain non-limiting embodiments, the combined outlet cross-sectional area can be less than the inlet cross-sectional area, for example. In other non-limiting embodiments, the combined outlet cross-sectional area can be greater than the inlet cross-sectional area. Additionally or alternatively, in various embodiments, the cross-sectional area of the inlet 146 to the refining hearth 142 can match or be similar to the cross-sectional area of the refining hearth 142 at, near, and/or adjacent to the inlet 146, for example. In such embodiments, upon entering the refining hearth 142, the molten material can maintain its inlet velocity, and, furthermore, its velocity can subsequently increase along the tapered length of the refining hearth 142.

Figure 4:
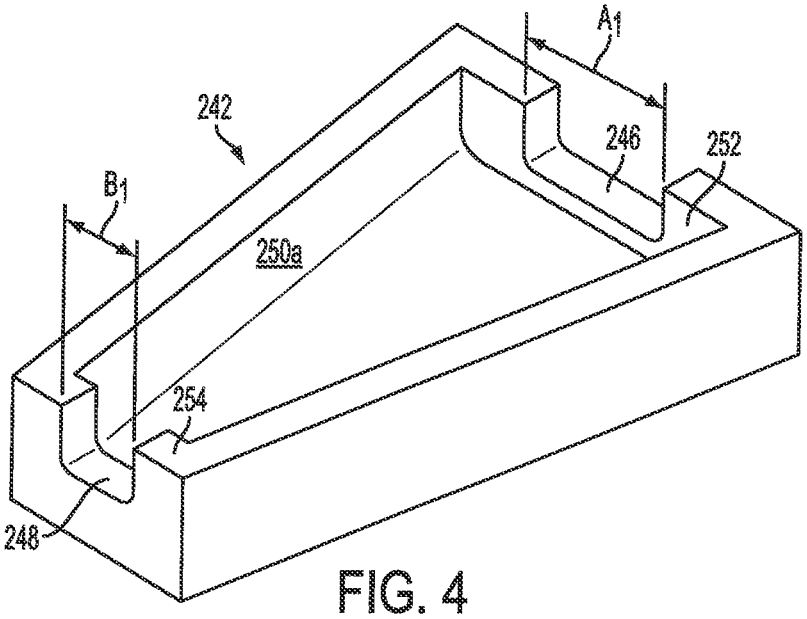
FIG. 4 is a perspective view of a hearth according to at least one non-limiting embodiment of the present disclosure.
Figure 5:
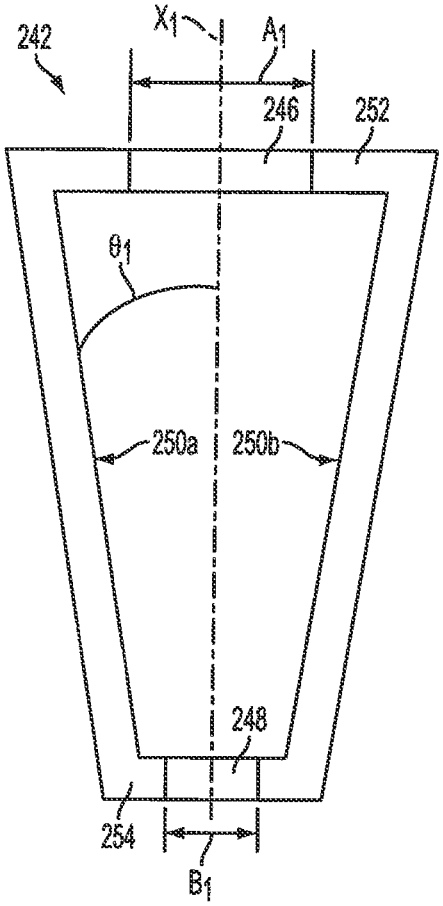
FIG. 5 is a plan view of the hearth of FIG. 4.

Referring now to FIGS. 4 and 5, a refining hearth 242 having an improved geometry is shown. The refining hearth 242 can include an inlet 246 at or near a first end 252 and an outlet 248 at or near a second end 254. In various non-limiting embodiments, the outlet 248 can have a pour lip for directing molten material into an adjacent mold. Molten material passing through the refining hearth 242 can enter the refining hearth 242 via the inlet 246 and can exit the refining hearth 242 via the outlet 248. In other words, the flow of molten material can be directed from the inlet 246 toward the outlet 248. Further, the refining hearth 242 can include sidewalls 250*a*, 250*b*, which can extend between the first end 252 and the second end 254, for example. Referring primarily to FIG. 5, the refining hearth 242 can define an axis $X_1$, and, in certain non-limiting embodiments, the refining hearth 242 can be symmetrical relative to the axis $X_1$. In various non-limiting embodiments, the sidewalls 250*a*, 250*b* can be angularly oriented relative to the axis $X_1$, and an angle $\theta_1$ can be defined between each sidewall 250*a*, 250*b* and the axis $X_1$. In various non-limiting embodiments, $\theta_1$ can be approximately 4 degrees, for example. In certain non-limiting embodiments, angle $\theta_1$ can be approximately 1 degree to approximately 10 degrees, for example, and in at least one non-limiting embodiment, angle $\theta_1$ can be less than 1 degree, for example, and/or greater than 10 degrees, for example. In other words, the sidewalls 250*a*, 250*b* of the refining hearth 242 can taper and/or narrow between the inlet 246 at or near the first end 252 and the outlet 248 at or near the second end 254. In various non-limiting embodiments, the sidewalls 250*a*, 250*b* can continually taper between the inlet 146 and the outlet 248. Further, the sidewalls 250*a*, 250*b* can be curved and/or straight between the inlet 246 and the outlet 248 and the degree of taper can vary along the length thereof. For example, a portion of the sidewalls 250*a*, 250*b* can be curved and/or a portion of the sidewalls 250*a*, 250*b* can be angled. Further, the curve or curves can have various radii of curvature, for example, and the angled portion or portions can be angled to various degrees, for example. As described herein, to maintain a constant or substantially constant mass flow through the tapered cavity of the refining hearth 242, for example, the velocity of the molten material flowing therethrough can increase between the inlet 246 and the outlet 248.

Referring still to FIGS. 4 and 5, the inlet 246 can define an inlet cross-sectional area and the outlet 248 can define an outlet cross-sectional area that is less than the inlet cross-sectional area. For example, the outlet cross-sectional area can be approximately 10% to approximately 50% less than the inlet cross-sectional area. In certain non-limiting embodiments, the difference can be less than approximately 10%, for example, or greater than approximately 50%, for example. In various non-limiting embodiments, the inlet 246 can have an inlet width or diameter $A_1$ and the outlet 248 can have an outlet width or diameter $B_1$. In certain non-limiting embodiments, the outlet width $B_1$ can be less than the inlet width $A_1$. In various non-limiting embodiments, the inlet width $A_1$ can be approximately 12.5 inches, and the outlet width $B_1$ can be approximately 8.4 inches, for example. In certain non-limiting embodiments, the inlet width $A_1$ can be approximately 10.5 inches to approximately 14.5 inches, and the outlet width $B_1$ can be approximately 6.4 inches to approximately 10.4 inches, for example. In at least one non-limiting embodiment, the inlet width $A_1$ can be greater than approximately 14.5 inches or less than approximately 10.5 inches, for example, and outlet width $B_1$ can be greater than approximately 10.4 inches or less than approximately 6 inches, for example. The difference between the inlet width $A_1$ and the outlet width $B_1$ can depend on the length of the refining hearth 242, and/or the angle $\theta_1$, for example. In various non-limiting embodiments, additional or alternative dimensions can vary and/or match between the inlet 246 and the outlet 248, such that the inlet cross-sectional area is greater than the outlet cross-sectional area. For example, the inlet 246 can have an inlet height and the outlet 248 can have an outlet height that is less than the inlet height. Alternatively, the inlet 242 and the outlet 248 can have a matching or similar height. For example, in various non-limiting embodiments, the height of the inlet 246 and the height of the outlet 248 can be approximately 2 inches. In certain non-limiting embodiments, the height of the inlet 246 and the outlet 248 can be approximately 1 inch to approximately 3 inches, for example, and, in at least one non-limiting embodiment, the height of the inlet 246 and the outlet 248 can be less than approximately 1 inch or greater than approximately 3 inches, for example. In various non-limiting embodiments, the inlet cross-sectional area can correspond to an inlet capacity, and the outlet cross-sectional area can correspond to an outlet capacity. In certain non-limiting embodiments, the outlet capacity can be less than the inlet capacity, for example.

In various embodiments, when selecting dimensions for the inlet 246 and/or the outlet 248, the position of the low edge of the outlet 248 and the low edge of the inlet 246 can be considered. For example, in certain non-limiting embodiments, the low edge of the outlet 248 can be higher than the low edge of the inlet 246. In such non-limiting embodiments, the higher low edge of the outlet can prevent inclusions that have fallen toward the bottom of the refining hearth 242 and/or toward the skull from passing through the outlet 248. In certain non-limiting embodiments, the low edge of the outlet 248 can be at substantially the same level as the low edge of the inlet 246.

In certain non-limiting embodiments, the inlet cross-sectional area can match or substantially match the cross-sectional area of the refining hearth 242 at, near or adjacent to the inlet 242, for example. The outlet cross-sectional area can be approximately 1% to approximately 5% different than the inlet cross-sectional area, for example. In certain non-limiting embodiments, the outlet cross-sectional area can be less than approximately 1% different than the inlet cross-sectional area, for example. In other non-limiting embodiments, the outlet cross-sectional area can be greater than approximately 5% different than the inlet cross-sectional area, and, for example, can be approximately 10% different than the inlet cross-sectional area. In various non-limiting embodiments, the outlet cross-sectional area can be greater than the inlet cross-sectional area.

In various non-limiting embodiment, the length of the refining hearth 242 between the first end 252 and the second end 254 can be approximately 30 inches, for example. In certain non-limiting embodiments, the length of the refining hearth 242 can be approximately 20 inches to approximately 40 inches, for example, and, in at least one non-limiting embodiment, the length of the refining hearth can be less than approximately 20 inches or greater than approximately 40 inches, for example. In various non-limiting embodiments, the depth of the refining hearth can be approximately 6 inches. In certain non-limiting embodiments, the depth of the refining hearth 242 can be approximately 4 inches to approximately 8 inches, for example, and, in at least one non-limiting embodiment, the depth of the refining hearth 242 can be less than approximately 4 inches and/or greater than approximately 8 inches, for example. The depth of the skull in the refining hearth 242 can vary along the length and width of the refining hearth 242. The skull of solid material in the refining hearth 242 can fill a portion of the refining hearth. For example, the skull can be approximately 4 inches deep along a portion of the length of the refining hearth 242. In certain non-limiting embodiments, the depth of the skull can be approximately 2 inches to approximately 6 inches, for example, and, in at least one non-limiting embodiment, the depth of the skull can be less than approximately 2 inches or greater than approximately 6 inches, for example. As described herein, the shape and size of the skull can be designed and controlled by the application of energy to the refining hearth 242.

In various non-limiting embodiments, referring still to FIGS. 4 and 5, the inlet width $A_1$ can be less than the width of the cavity defined between the side walls 250*a*, 250*b* of the refining hearth 242 adjacent to the inlet 246. Further, the inlet cross-sectional area can be less than the cross-sectional area of the refining hearth 242 cavity adjacent to the inlet 246. In such embodiments, upon entering the refining hearth 242, the velocity of the molten material may initially decrease. However, as the molten material travels through the tapered cavity of the refining hearth 242 toward the outlet 248, the velocity of the molten material can increase.

Figure 6:
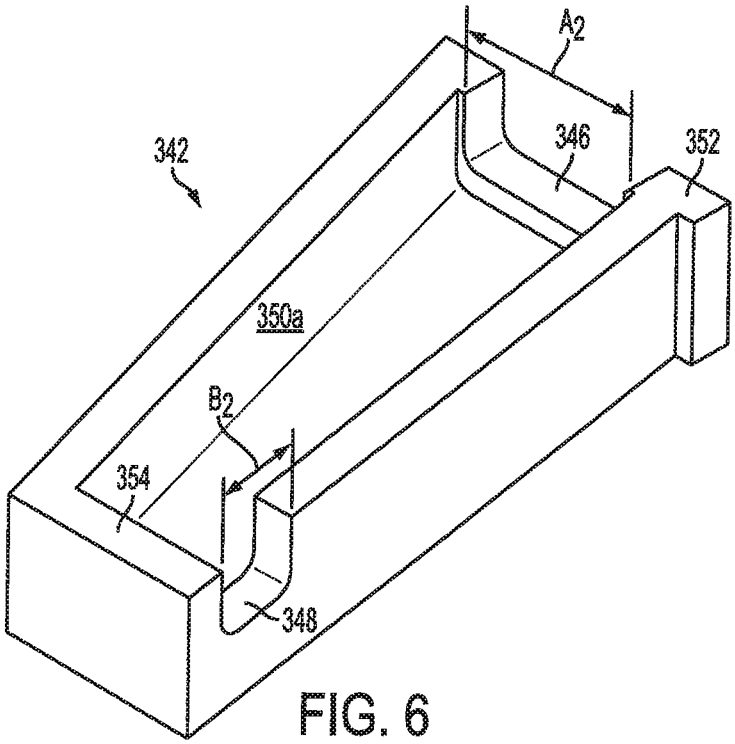
FIG. 6 is a perspective view of a hearth according to at least one non-limiting embodiment of the present disclosure.
Figure 7:
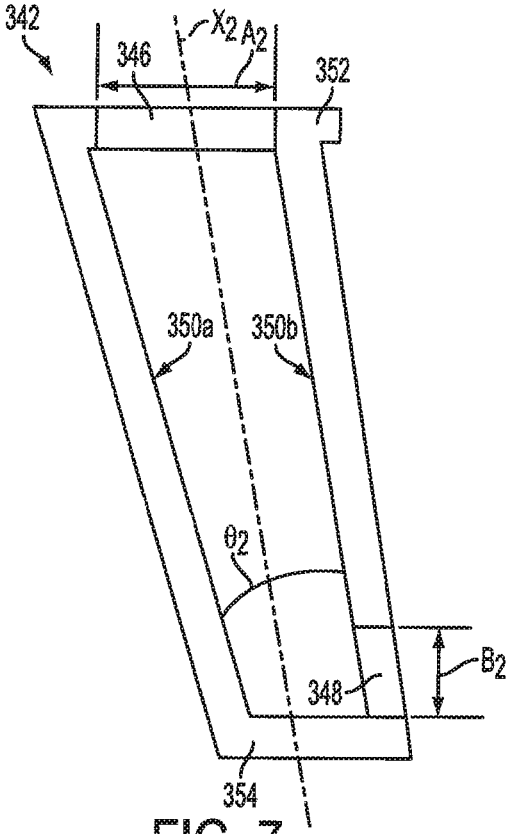
FIG. 7 is a plan view of the hearth of FIG. 6.

Referring now to FIGS. 6 and 7, a refining hearth 342 having an improved geometry can be similar to the refining hearth 242 (FIGS. 4 and 5) described herein. For example, the refining hearth 342 can include an inlet 346 at or near a first end 352 and an outlet 348 at or near a second end 354. Molten material passing through the refining hearth 342 can enter the refining hearth 342 via the inlet 346 and can exit the refining hearth 342 via the outlet 348. In other words, the flow of molten material can be directed from the inlet 346 toward the outlet 348. Further, the refining hearth 342 can include sidewalls 350*a*, 350*b*, which can extend between the first end 352 and the second end 354, for example. In various non-limiting embodiments, the outlet 348 can be defined through a sidewall 350*a*, 350*b* of the refining hearth 242.

Referring primarily to FIG. 7, the refining hearth 342 can define an axis $X_2$, which can be parallel to a sidewall 350*a*, 350*b*. In certain non-limiting embodiments, the refining hearth 342 can be asymmetrical relative to the axis $X_2$, and the sidewalls 350*a*, 350*b* may not be parallel, for example. In various non-limiting embodiments, at least one of the sidewalls 350*a*, 350*b* can be angularly oriented relative to the axis $X_2$, and an angle $\theta_2$ can be defined between the sidewalls 350*a*, 350*b* of the refining hearth 342. For example, sidewall 350*a* can be angularly oriented relative to the axis, and sidewall 350*b* can be parallel to axis $X_2$. In various non-limiting embodiments, angle $\theta_2$ can be approximately 8 degrees, for example. In certain non-limiting embodiments, angle $\theta_2$ can be approximately 2 degrees to approximately 30 degrees, for example. In at least one non-limiting embodiment, angle $\theta_2$ can be less than approximately 2 degrees, for example, and/or greater than approximately 30 degrees, for example. In other words, the sidewalls 350*a*, 350*b* of the refining hearth 342 can taper and/or narrow between the inlet 346 at or near the first end 352 and the outlet 348 at or near the second end 354. In various non-limiting embodiments, the sidewalls 350*a*, 350*b* can continually taper between the inlet 346 and the outlet 348. Further, the sidewalls 350*a*, 350*b* can be curved and/or straight between the inlet 346 and the outlet 348 and the degree of taper can vary along the length thereof. For example, a portion of the sidewalls 350*a*, 350*b* can be curved and/or a portion of the sidewalls 350*a*, 350*b* can be angled. Further, the curve or curves can have various radii of curvature, for example, and the angled portion or portions can be angled to various degrees, for example. As described herein, to maintain a constant or substantially constant mass flow through the tapered hearth 342, for example, the velocity of the molten material flowing therethrough can increase between the inlet 346 and the outlet 348.

Referring still to FIGS. 6 and 7, the inlet 346 can define an inlet cross-sectional area and the outlet 348 can define an outlet cross-sectional area that is less than the inlet cross-sectional area. For example, the outlet cross-sectional area can be approximately 10% to approximately 50% less than the inlet cross-sectional area. In certain non-limiting embodiments, the difference can be less than approximately 10%, for example, or greater than approximately 50%, for example. In various embodiments, the inlet 346 can have an inlet width or diameter $A_2$ and the outlet 348 can have an outlet width or diameter $B_2$. In various non-limiting embodiments, the inlet width $A_2$ can match or substantially match the width of the cavity defined between the sidewalls 350*a*, 350*b* of the refining hearth 342 at, near, and/or adjacent to the inlet 346. Further, the inlet cross-sectional area can match or substantially match the cross-sectional area of the cavity of the refining hearth 342 at, near, and/or adjacent to the inlet 346, for example. Where the cross-sectional area of the inlet 346 matches or substantially matches the cross-sectional area of the refining hearth 342 adjacent to the inlet 346, the velocity of the molten material entering the refining hearth 342 via the inlet 346 can be maintained or substantially maintained. Stated differently, the velocity of the molten material may not decrease or substantially decrease upon entering the refining hearth 342. In various non-limiting embodiments, similar to the inlet width $A_1$ and the outlet width $B_1$ of the refining hearth 242 described herein, the outlet width $B_2$ can be less than the inlet width $A_2$. In various non-limiting embodiments, additional or alternative dimensions can vary and/or match between the inlet 346 and the outlet 348, such that the inlet cross-sectional area is greater than the outlet cross-sectional area. In certain non-limiting embodiments, the inlet cross-sectional area can match or substantially match the outlet cross-sectional area, and, in other non-limiting embodiments, the inlet cross-sectional area can be less than the outlet cross-sectional area.

Figure 8:
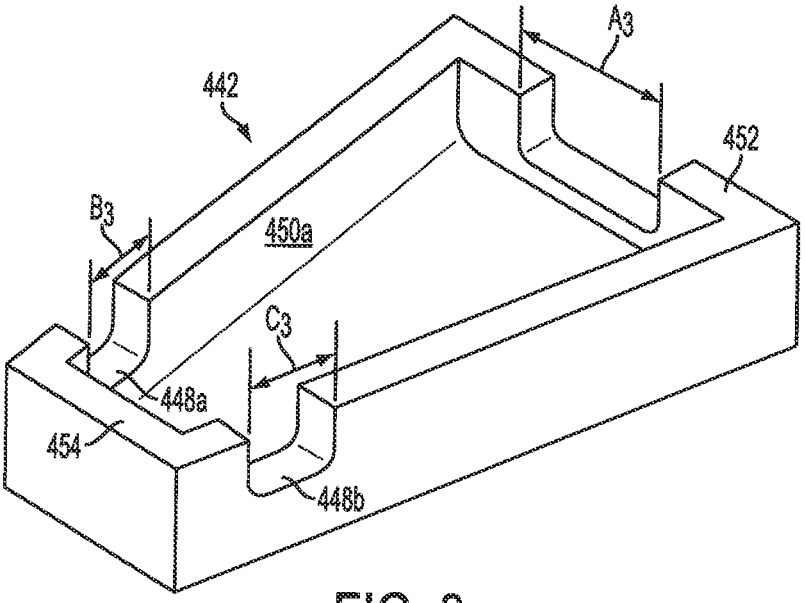
FIG. 8 is a perspective view of a hearth according to at least one non-limiting embodiment of the present disclosure.
Figure 9:
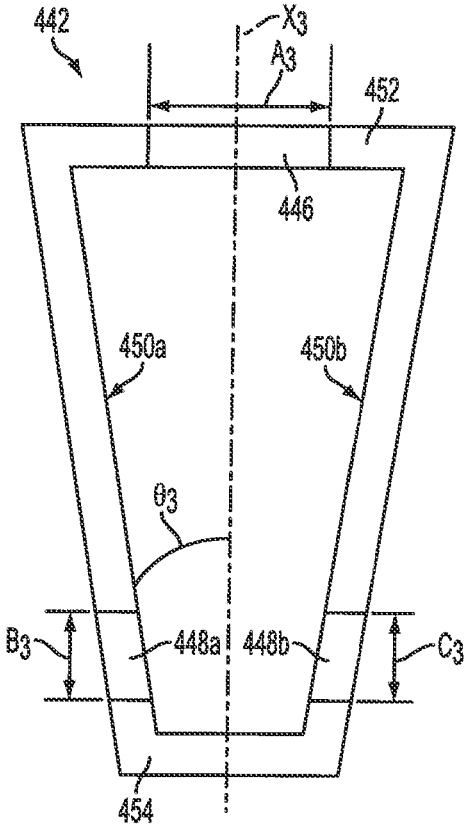
FIG. 9 is a plan view of the hearth of FIG. 8.

Referring now to FIGS. 8 and 9, similar to refining hearth 142 (FIG. 3) described herein, a refining hearth 442 can include an inlet 446 near a first end 452 and a pair of outlets 448*a*, 448*b* near a second end 454. Molten material passing through the refining hearth 442 can enter the refining hearth 442 via the inlet 446 and can exit the refining hearth 442 via the outlets 448*a*, 448*b*. In other words, the flow of molten material can be directed from the inlet 446 toward the outlets 448*a*, 448*b*. Further, the refining hearth 442 can include sidewalls 450*a*, 450*b*, which can extend between the first end 452 and the second end 454, for example. The outlets 448*a*, 448*b* can be defined through the sidewalls 450*a*, 450*b*. In various non-limiting embodiments, the flow of molten material can bifurcate or separate to flow into the outlets 448*a*, 448*b* on opposite sidewalls 450*a*, 450*b* of the refining hearth 452. Referring to FIG. 9, the refining hearth 442 can define an axis $X_3$, and, in certain non-limiting embodiments, the refining hearth 442 can be symmetrical relative to the axis $X_3$. In such embodiments, the outlets 448*a*, 448*b* can be symmetrical. In various non-limiting embodiments, each sidewall 450*a*, 450*b* can be angularly oriented relative to the axis $X_3$, and an angle $\theta_3$ can be defined between each sidewall 450*a*, 450*b* and the axis $X_3$. In various non-limiting embodiments, angle $\theta_3$ can be approximately 4 degrees, for example. In certain non-limiting embodiments, angle $\theta_3$ can be approximately 1 degree to approximately 30 degrees, for example, and, in at least one non-limiting embodiment, angle $\theta_3$ can be less than approximately 1 degree, for example, and/or greater than approximately 30 degrees, for example. In other words, the sidewalls 450*a*, 450*b* of the refining hearth 442 can taper and/or narrow between the inlet 446 near the first end 452 and the outlets 448*a*, 448*b* near the second end 454. In various non-limiting embodiments, the sidewalls 450*a*, 450*b* can continually taper between the inlet 446 and the outlets 448*a*, 448*b*. Further, the sidewalls 450*a*, 450*b* can be curved and/or straight between the inlet 446 and the outlets 448*a*, 448*b* and the degree of taper can vary along the length thereof. For example, a portion of the sidewalls 450*a*, 450*b* can be curved and/or a portion of the sidewalls 450*a*, 450*b* can be angled. Further, the curve or curves can have various radii of curvature, for example, and the angled portion or portions can be angled to various degrees, for example. As described herein, to maintain a constant or substantially constant mass flow through the tapered hearth 442, for example, the velocity of the molten material flowing therethrough can increase between the inlet 446 and the outlets 448*a*, 448*b*.

Referring still to FIGS. 8 and 9, the inlet 446 can define an inlet cross-sectional area and the outlets 448*a*, 448*b* can define outlet cross-sectional areas. The total or sum of the outlet cross-sectional areas, i.e., the combined outlet cross-sectional area, can match or be similar to the inlet cross-sectional area. In various non-limiting embodiments, the combined outlet cross-sectional area can be approximately 1% to approximately 5% different than the inlet cross-sectional area. In certain non-limiting embodiments, the combined outlet cross-sectional area can be less than approximately 1% different than the inlet cross-sectional area. In other non-limiting embodiments, the combined outlet cross-sectional area can be greater than approximately 5% different than the inlet cross-sectional area, and, for example, can be approximately 10% different than the inlet cross-sectional area. In various non-limiting embodiments, the inlet 446 can have an inlet width or diameter $A_3$, the first outlet 448*a* can have an outlet width or diameter $B_3$, and the second outlet 448*b* can have an outlet width or diameter $C_3$. In certain non-limiting embodiments, the sum of the outlet widths $B_3$ and $C_3$ can equal or substantially equal the inlet width $A_3$. For example, outlet widths $B_3$ and $C_3$ can be equal and each such outlet can be 50% the length of inlet width $A_3$. In various non-limiting embodiments, additional or alternative dimensions can vary and/or match between the inlet 446 and the outlets 448*a*, 448*b*, such that the combined outlet cross-sectional area matches the inlet cross-sectional area. In various non-limiting embodiments, the inlet cross-sectional area can correspond to an inlet capacity, and the combined outlet cross-sectional area can correspond to a combined outlet capacity. In certain non-limiting embodiments, the combined outlet capacity can match the inlet capacity, for example. In various non-limiting embodiments, the inlet cross-sectional area can be less than or greater than the combined outlet cross-sectional area, for example.

In various non-limiting embodiments, the energy source, such as the electron beam guns 30 (FIGS. 1 and 2) and/or plasma torches, can be arranged relative to a refining hearth to control the shape and size of the skull of material formed in the hearth. For example, the energy source can be controlled and directionally oriented relative to the hearth to manipulate the shape of the skull formed therein. Reference is made to U.S. Pat. No. 4,961,776 to Harker, the entire disclosure of which is incorporated by reference herein. The energy source directed toward and/or around the desired skull location can be controlled to permit the skull to solidify and grow at that desired location. In certain non-limiting embodiments, the energy source can be directed toward the refining hearth and so controlled to form a tapered skull. The tapered skull can form in a non-tapered hearth, such as in a conventional square and/or rectangular hearth, for example. Similar to the various embodiments described herein, the tapered geometry of the skull in the refining hearth can provide an improved flow path for the molten material.

The improved flow path in the refining hearth can increase the velocity of molten material flowing therethrough and can reduce the pressure in the molten material. Stated differently, to maintain a substantially constant mass flow through the tapered hearth, for example, the velocity of the molten material can increase from the inlet to the outlet, and the pressure in the molten material can correspondingly decrease from the inlet to the outlet. Furthermore, the improved flow path can provide a more direct flow path for the molten material, which can reduce and/or limit the formation of stagnant zones in the molten material. An improved molten material flow path with reduced stagnant zones can promote a more uniform residence time in the hearth. The defined residence time can be controlled to sufficiently vaporize the inclusions in the molten material while limiting and/or preventing excessive elemental depletion therein. Additionally, the improved flow path in the refining hearth can provide a more direct path for the molten material, and, during continuous casting operations of parallel molds, can promote identical or similar casting rates.

Figure 10:
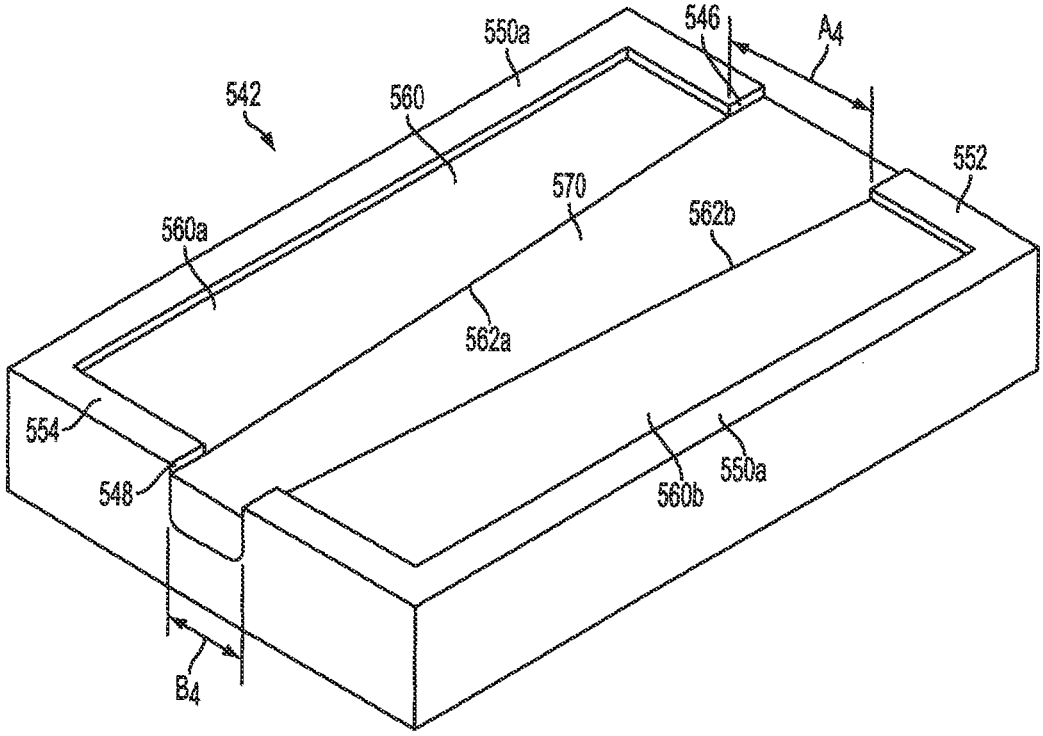
FIG. 10 is a perspective view of a hearth having material positioned therein according to at least one non-limiting embodiment of the present disclosure.
Figure 11:
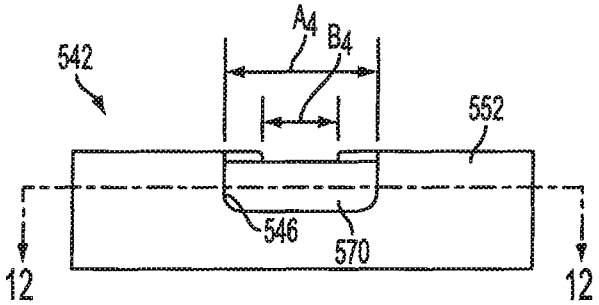
FIG. 11 is an elevation view of the hearth of FIG. 10.
Figure 12:
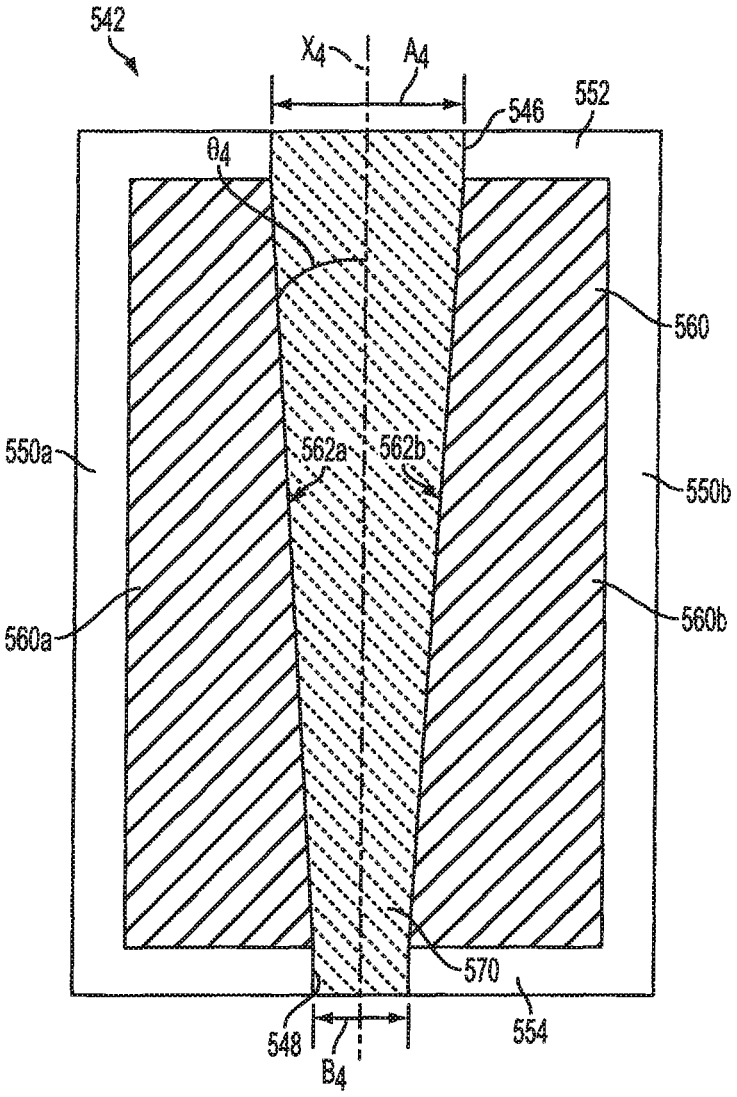
FIG. 12 is a plan, cross-sectional view of the hearth of FIG. 10 taken along the plane indicated in FIG. 11.

Referring now to FIGS. 10-12, a refining hearth 542 can include an inlet 546 at or near a first end 552 and an outlet 548 at or near a second end 554. Molten material 570 passing through the refining hearth 542 can enter the refining hearth 542 via the inlet 546 and can exit the refining hearth 542 via the outlet 548. In other words, the flow of molten material 570 can be directed from the inlet 546 toward the outlet 548. Further, in various non-limiting embodiments, the refining hearth 542 can include sidewalls 550*a*, 550*b*, which can extend between the first end 552 and the second end 554, for example. Referring to FIGS. 10 and 12, the refining hearth 542 can be rectangular, for example, and the sidewalls 550*a*, 550*b* can be parallel, for example. Further, referring primarily to FIG. 12, the refining hearth 542 can define an axis $X_4$ and, in certain non-limiting embodiments, the refining hearth 542 can be symmetrical relative to the axis $X_4$.

Referring still to FIGS. 10-12, an energy source, such as electron beam guns 30 (FIGS. 1 and 2) and/or plasma torches, can be controlled and arranged relative to the refining hearth 542 such that a tapered skull 560 forms therein. A first side 560*a* of the tapered skull 560 can form on a first side of the refining hearth 542 and a second side 560*b* of the tapered skull 560 can form on a second side of the refining hearth 542. In various embodiments, the skull 560 can develop symmetrically with respect to the axis $X_4$. Further, referring primarily to FIG. 12, edges 562*a*, 562*b* of each skull side 560*a*, 560*b* can be angularly oriented relative to the axis $X_4$, and an angle $\theta_4$ can be defined between the edge 562*a*, 562*b* of each skull side 560*a*, 560*b* and the axis $X_4$. In various non-limiting embodiments, angle $\theta_4$ can be approximately 4 degrees, for example. In certain non-limiting embodiments, angle $\theta_4$ can be approximately 1 degree to approximately 30 degrees, for example, and in at least one non-limiting embodiment, angle $\theta_4$ can be less than 1 degree, for example, and/or greater than 30 degrees, for example. In other words, the edges 562*a*, 562*b* of the skull sides 560*a*, 560*b* can taper and/or narrow between the inlet 546 near the first end 552 and the outlet 548 near the second end 554. For example, the cross-sectional area of the flow path defined by the skull 560 at, near, and/or adjacent to the inlet 546 can be approximately 10% to approximately 50% greater than the cross-sectional area of the flow path defined by the skull 560 at, near, and/or adjacent to the outlet 548. In certain non-limiting embodiments, the difference can be less than approximately 10%, for example, or greater than approximately 50%, for example. In various non-limiting embodiments, the edges 562*a*, 562*b* can continually taper between the inlet 546 and the outlet 548. Further, the edges 562*a*, 562*b* can be curved and/or straight between the inlet 546 and the outlet 548 and the degree of taper can vary along the length thereof. For example, a portion of the edges 562*a*, 562*b* can be curved and/or a portion of the edges 562*a*, 562*b* can be angled. Further, the curve or curves can have various radii of curvature, for example, and the angled portion or portions can be angled to various degrees, for example.

Referring still to FIGS. 10-12, the inlet 546 can define an inlet cross-sectional area and the outlet 548 can define an outlet cross-sectional area, which can be less than the inlet cross-sectional area, similar to the refining hearth 242 (FIGS. 4 and 5). For example, the inlet 546 can have an inlet width or diameter $A_4$ and the outlet 548 can have an outlet width or diameter $B_4$. In certain non-limiting embodiments, the outlet width $B_4$ can be less than the inlet width $A_4$, similar to the inlet width $A_1$ and the outlet width $B_1$ of refining hearth 542, for example. In various non-limiting embodiments, additional or alternative dimensions can vary and/or match between the inlet 546 and the outlet 548, such that the inlet cross-sectional area is greater than the outlet cross-sectional area. In various non-limiting embodiments, the edges 562*a*, 562*b* of the skull sides 560*a*, 560*b* can align or substantially align with the inlet 546 at the first end 552 and with the outlet 548 at the second end 554. In other words, the edge 562*a* of skull side 560*a* can extend from the inlet 546 to the outlet 548 on a first side of the refining hearth 542, and the edge 562*b* of skull side 560*b* can extend from the inlet 546 to the outlet 548 on a second, opposite side of the refining hearth 542. In such embodiments, the cross-sectional area of the flow path of molten material 570 can match the inlet cross-sectional area at the inlet 546, and can match the outlet cross-sectional area at the outlet 548. Where the edges 562*a*, 562*b* of the skull sides 560*a*, 560*b* align with the inlet 546, upon entering the flow path defined by the tapered skull 560 in the hearth 542, the velocity of the molten material can be maintained or substantially maintained. Then, as the molten material 570 flows through the tapered skull 560 toward the outlet 548, the velocity of the molten material 570 can increase. In various non-limiting embodiments, the inlet cross-sectional area can correspond to an inlet capacity, and the outlet cross-sectional area can correspond to an outlet capacity. In certain non-limiting embodiments, the outlet capacity can be less than the inlet capacity, for example. In various non-limiting embodiments, the inlet cross-sectional area can match or substantially match the outlet cross-sectional area, and, in other embodiments, the inlet cross-sectional area can be less than the outlet cross-sectional area.

Figure 13:
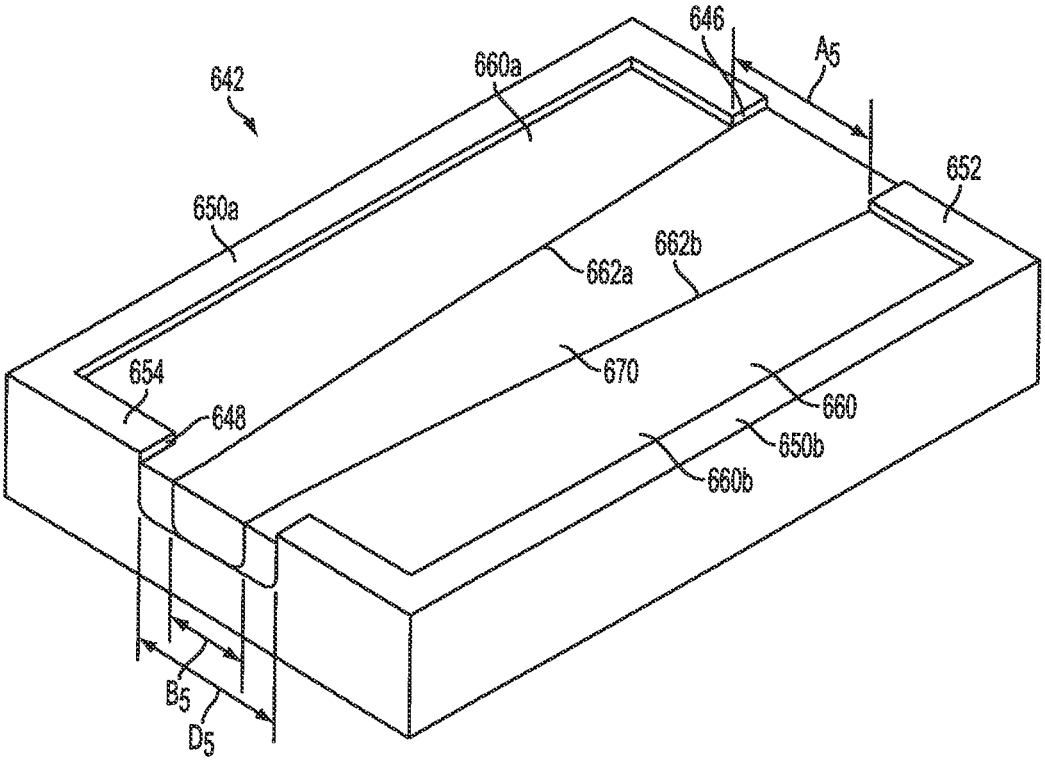
FIG. 13 is a perspective view of a hearth having material positioned therein according to at least one non-limiting embodiment of the present disclosure.
Figure 14:
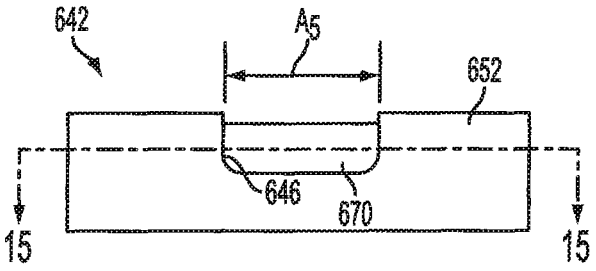
FIG. 14 is an elevation view of the hearth and material of FIG. 13.
Figure 15:
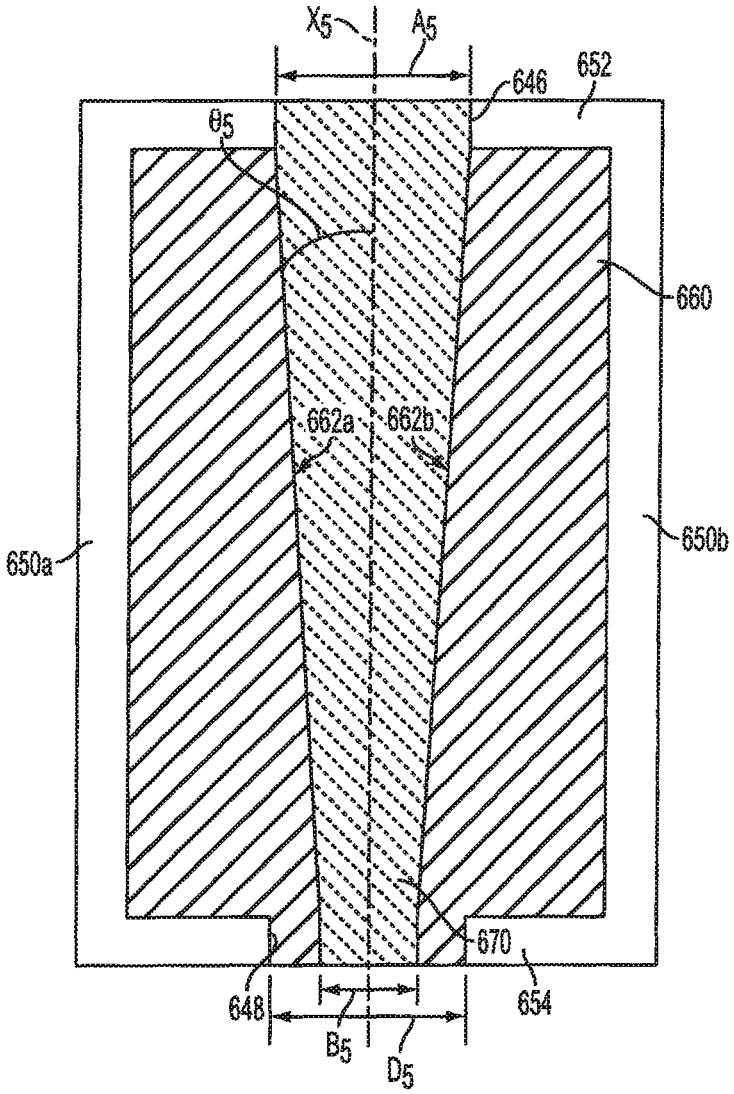
FIG. 15 is a plan view of the hearth and material of FIG. 13 taken along the plane indicated in FIG. 14.

Referring now to FIGS. 13-15, a refining hearth 642 can be substantially similar to the refining hearth 542 (FIGS. 10-12). For example, molten material 670 can enter the refining hearth 642 via an inlet 646 at the first end 652 and can exit the refining hearth 642 via an outlet 648 at the second end 654. Further, in various non-limiting embodiments, the refining hearth 642 can be rectangular, for example, and the sidewalls 650*a*, 650*b* can be parallel. Referring to FIG. 15, the refining hearth 642 can define an axis $X_5$ and, in certain non-limiting embodiments, the refining hearth 642 and the tapered skull 660 formed therein can be symmetrical relative to the axis $X_5$.

Referring still to FIGS. 13-15, the inlet 646 can define an inlet cross-sectional area and the outlet 648 can define an outlet cross-sectional area, which can be equal to the inlet cross-sectional area. For example, the inlet 646 to the refining hearth 642 can have an inlet width or diameter $A_5$ and the outlet 648 to the refining hearth 642 can have an outlet width or diameter $D_5$, which can match or be similar to the inlet width $A_5$. In other words, $A_5$ can equal $D_5$, for example. Though the inlet width $A_5$ of the refining hearth 642 can match the outlet width $D_5$ of the refining hearth 642, the skull 660 can define a tapered flow path of molten material 670 within the refining hearth 642. To maintain a constant or substantially constant mass flow through the tapered skull 660, for example, the velocity of the molten material flowing therethrough can increase between the inlet 646 and the outlet 648 of the refining hearth 642.

In certain non-limiting embodiments, a first side 660*a* of the skull can form on a first side of the refining hearth 642 and a second side 660*b* of the skull can form on a second side of the refining hearth 642. For example, the edges 662*a*, 662*b* of each skull side 660*a*, 660*b* can align or substantially align with the inlet 646 of the refining hearth 642 at the first end 652, and can taper from the inlet 646 to define a narrower flow path width $B_5$ at the second end 654 of the refining hearth 642 and through the outlet 648. In other words, the flow path width $B_5$ defined by the skull sides 660*a*, 660*b* at the outlet 648 can be less than the outlet width $D_5$. Further, in various non-limiting embodiments, the skull 660 can define an inlet capacity and/or an outlet capacity. For example, referring to FIGS. 13-15, the skull 660 can define the outlet capacity at outlet 648. Further, the skull 660 can define the inlet capacity at the inlet 646, for example. In various non-limiting embodiments, the outlet capacity defined by the skull 660 can be less than the inlet capacity defined by the skull 660 at the inlet 646. Furthermore, the cross-sectional area of the flow path defined by the skull 660 at, near, and/or adjacent to the inlet 646 can be approximately 10% to approximately 50% less than the cross-sectional area of the flow path defined by the skull 660 at, near, and/or adjacent to the outlet 648. In certain non-limiting embodiments, the difference can be less than approximately 10%, for example, or greater than approximately 50%, for example.

Figure 16:
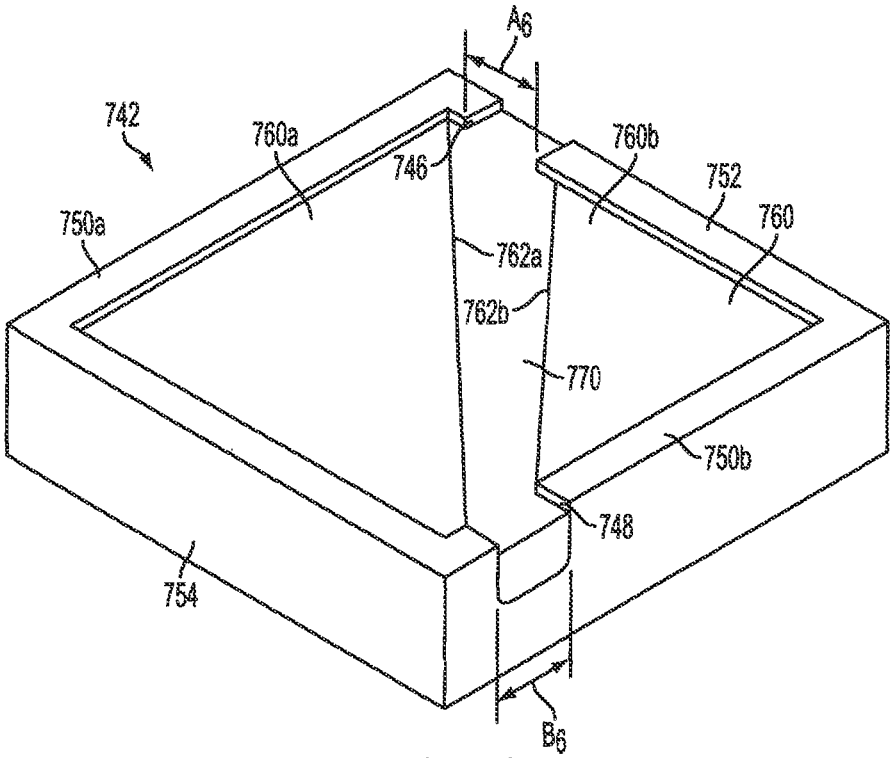
FIG. 16 is a perspective view of a hearth having material positioned therein according to at least one non-limiting embodiment of the present disclosure.
Figure 17:
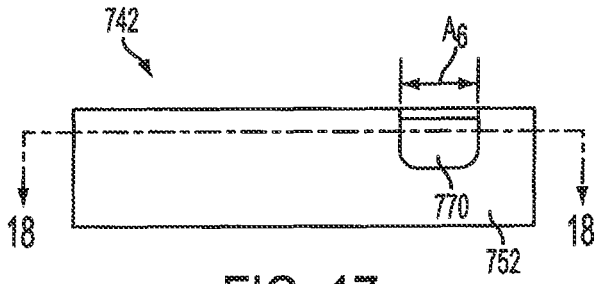
FIG. 17 is an elevation view of the hearth and material of FIG. 16.
Figure 18:
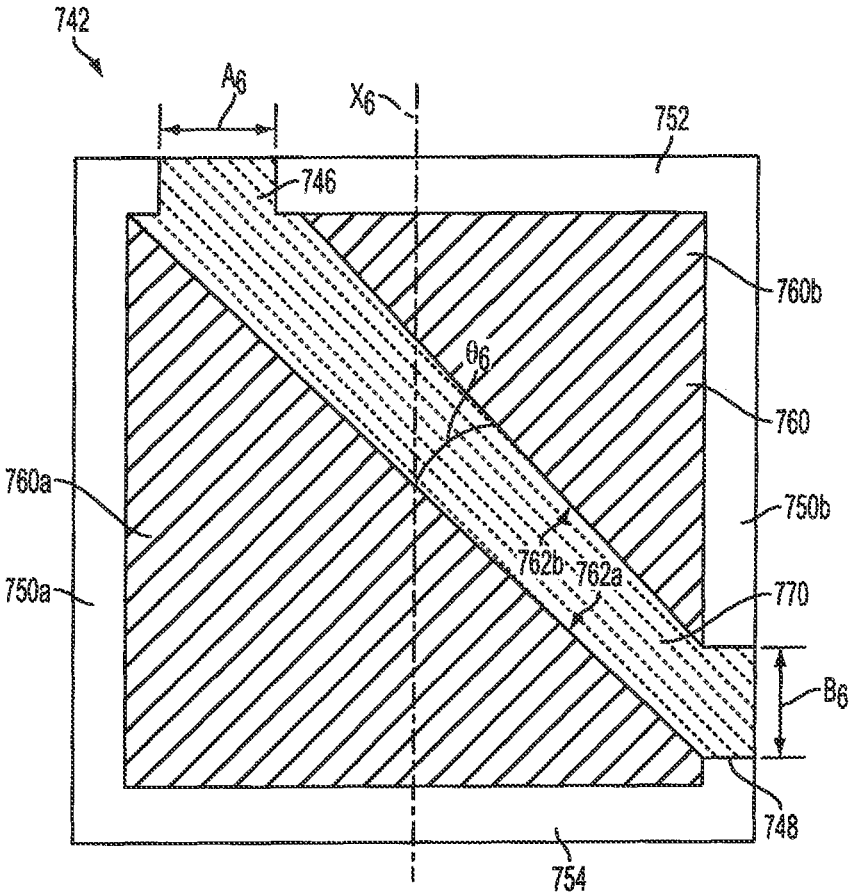
FIG. 18 is a plan view of the hearth and material of FIG. 16 taken along the plane indicated in FIG. 17.

Referring now to FIGS. 16-18, a refining hearth 742 can include an inlet 746 at or near a first end 752 and an outlet 748 at or near a second end 754. Molten material 770 passing through the refining hearth 742 can enter the refining hearth 742 via the inlet 746 and can exit the refining hearth 742 via the outlet 748. In other words, the flow of molten material 770 can be directed from the inlet 746 toward the outlet 748.

Further, in various non-limiting embodiments, the refining hearth 742 can include sidewalls 750*a*, 750*b*, which can extend between the first end 752 and the second end 754, for example. The refining hearth 742 can be square, for example, and the sidewalls 750*a*, 750*b* can be parallel. Referring to FIGS. 16 and 18, the outlet 748 can be defined through the sidewall 750*b*, for example. In other non-limiting embodiments, the inlet 746 and/or the outlet 748 can be defined through a sidewall 750*a*, 750*b* of the refining hearth 742. Referring primarily to FIG. 18, the refining hearth 742 can define an axis $X_6$ and, in certain non-limiting embodiments, the refining hearth 742 can be asymmetrical relative to the axis $X_6$.

In various non-limiting embodiments, similar to various embodiments described herein, an energy source, such as electron beam guns 30 (FIGS. 1 and 2) and/or plasma torches, can be controlled and arranged relative to the refining hearth 742 such that a tapered skull 760 forms therein. In various embodiments, the skull 760 can develop asymmetrical to the axis $X_6$. For example, the skull 760 can form a flow path of molten material 770 that traverses the axis $X_6$. In certain non-limiting embodiments, the flow path of molten material 770 can extend from the first end 752 of the refining hearth 742 to the second end 754 and may extend to an outlet 748 in a sidewall 750*a*, 750*b*, for example. A first side 760*a* of the skull 760 can form on a first side of the refining hearth 742 and a second side 760*b* of the skull 760 can form on a second side of the refining hearth 742. Further, referring primarily to FIG. 18, edges 762*a*, 762*b* of the skull sides 760*a*, 760*b* can be angularly oriented relative to each other, and an angle $\theta_6$ can be defined between the edges 762*a*, 762*b* of the skull sides 760*a*, 760*b*. In various non-limiting embodiments, angle $\theta_6$ can be approximately 8 degrees, for example. In certain non-limiting embodiments, angle $\theta_6$ can be approximately 2 degrees to approximately 30 degrees, for example, and, in at least one non-limiting embodiment, angle $\theta_6$ can be less than 2 degrees, for example, and/or greater than 30 degrees, for example. In other words, the edges 762*a*, 762*b* of the skull sides 760*a*, 760*b* can taper and/or narrow between the inlet 746 near the first end 752 and the outlet 748 near the second end 754. In various non-limiting embodiments, the edges 762*a*, 762*b* of the skull sides 760*a*, 760*b* can continually taper between the inlet 746 and the outlet 748. Further, the edges 762*a*, 762*b* can be curved and/or straight between the inlet 746 and the outlet 748 and the degree of taper can vary along the length thereof. For example, a portion of the edges 762*a*, 762*b* can be curved and/or a portion of the edges 762*a*, 762*b* can be angled. Further, the curve or curves can have various radii of curvature, for example, and the angled portion or portions can be angled to various degrees, for example. As described herein, to maintain a constant or substantially constant mass flow through the tapered skull 760, for example, the velocity of the molten material flowing therethrough can increase between the inlet 746 and the outlet 748 of the refining hearth 642.

Referring still to FIGS. 16-18, the inlet 746 can define an inlet cross-sectional area and the outlet 748 can define an outlet cross-sectional area, which can match or be similar to the inlet cross-sectional area, similar to the refining hearth 642 (FIGS. 13-15). In various non-limiting embodiments, the outlet cross-sectional area can be approximately 1% to approximately 5% different than the inlet cross-sectional area. In certain non-limiting embodiments, the outlet cross-sectional area can be less than approximately 1% different than the inlet cross-sectional area. In other non-limiting embodiments, the outlet cross-sectional area can be greater than approximately 5% different than the inlet cross-sectional area, and, for example, can be approximately 10% different than the inlet cross-sectional area. In various embodiments, the inlet 746 can have an inlet width or diameter $A_6$ and the outlet 748 can have an outlet width or diameter $B_6$. In certain non-limiting embodiments, the outlet width $B_6$ can equal the inlet width $A_6$. In various non-limiting embodiments, additional or alternative dimensions can match and/or vary between the inlet 746 and the outlet 748, such that inlet cross-sectional area is substantially equal to the outlet cross-sectional area. In other words, the inlet 746 and the outlet 758 can define equal or similar cross-sectional areas though the cross-sectional shapes of the inlet 746 and the outlet 748 differ.

In various non-limiting embodiments, the skull 760 can define a flow path of molten material 770 that is wider than the inlet width $A_6$ at the inlet 746 and narrows to match the outlet width $B_6$ at the outlet 748. In other words, the cross-sectional area of the flow path of molten material 770 defined by the skull 760 adjacent to the inlet 746 can be larger than the cross-sectional area of the inlet 746. Furthermore, the flow path of molten material 770 defined by the skull 760 adjacent to the outlet 748 can match the cross-sectional area of the outlet 748. In such embodiments, the velocity of the molten material 770 can decrease upon entering the wider portion of the skull 760 adjacent to the inlet 746. However, as the molten material 770 flows through the tapered skill 760 toward the outlet 748, the velocity of the molten material 770 can increase.

Figure 19:
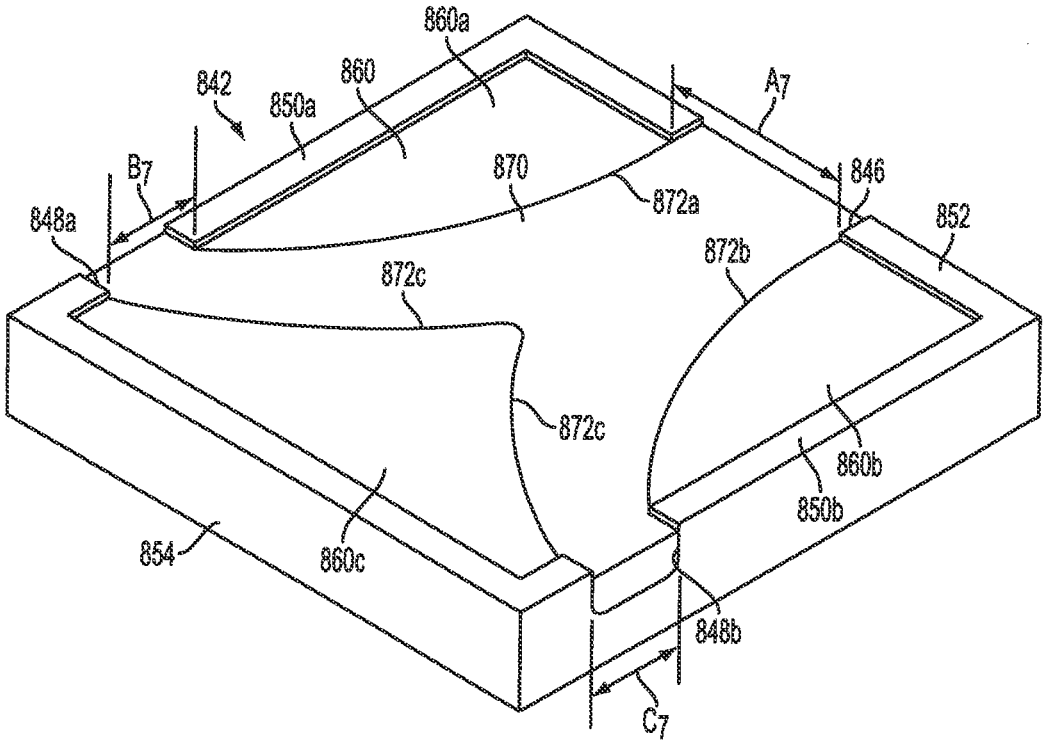
FIG. 19 is a perspective view of a hearth having material positioned therein according to at least one non-limiting embodiment of the present disclosure.
Figure 20:
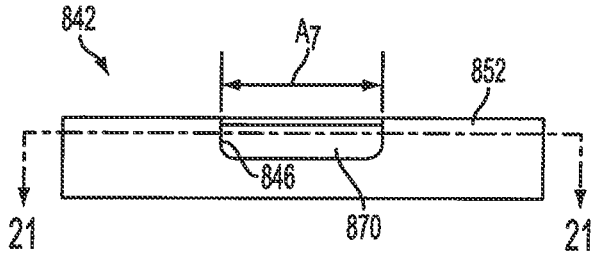
FIG. 20 is an elevation view of the hearth and material of FIG. 19.
Figure 21:
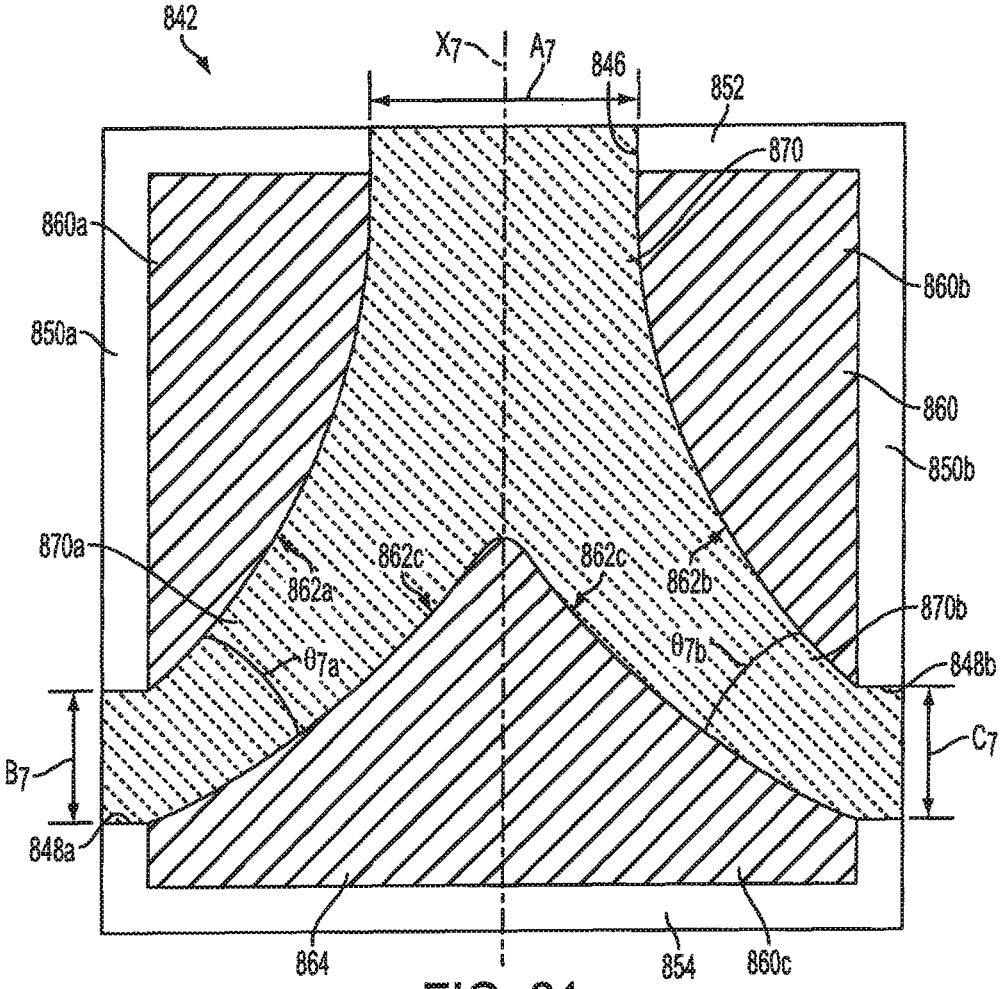
FIG. 21 is a plan view of the hearth and material of FIG. 19 taken along the plane indicated in FIG. 20.

Referring now to FIGS. 19-21, a refining hearth 842 can include an inlet 846 at or near a first end 852 and a pair of outlets 848*a*, 848*b* at or near a second end 854. Molten material 870 passing through the refining hearth 842 can enter the refining hearth 842 via the inlet 846 and can exit the refining hearth 842 via the outlets 848*a*, 848*b*. In other words, the flow of molten material 870 can be directed from the inlet 846 toward the outlets 848*a*, 848*b*. As described herein, an energy source, such as electron beam guns 30 (FIGS. 1 and 2), can be controlled and arranged relative to the refining hearth 842 such that a tapered skull 860 forms therein. In certain non-limiting embodiments, the tapered skull 860 can direct molten material 870 from the inlet 846 toward the outlets 848*a*, 848*b*. Further, the refining hearth 852 can have sidewalls 850*a*, 850*b* extending between the first end 852 and the second end 854. In various non-limiting embodiments, the refining hearth 842 can be square, and the sidewalls 850*a*, 850*b* can be parallel, for example. Though the refining hearth 842 may be a square and/or rectangular, the skull 860 can taper between in the inlet 846 and the outlets 848*a*, 848*b* to form a tapered flow path for the molten material 870. In various embodiments, a first side 860*a* of the skull can form on a first side of the refining hearth 842 and a second side 860*b* of the skull can form on a second side of the refining hearth 842. Further, in certain non-limiting embodiments, the skull 860 can include a central portion 860*a* between the outlets 848*a*, 848*b* and between the first and second sides 860*a*, 860*b*. The central portion 860*a* can bifurcate the flow path of the molten material 870 to direct a first portion 870*a* of molten material toward the outlet 848*a* and a second portion 870*b* of molten material toward the outlet 848*b*, for example.

Referring primarily to FIG. 21, the refining hearth 842 can define an axis $X_7$, and, in certain non-limiting embodiments, the refining hearth 842 can be symmetrical relative to the axis $X_7$. In such embodiments, the outlets 848*a*, 848*b* can be symmetrical, and each outlet 848*a*, 848*b* can be defined through a sidewall 850*a*, 850*b* near the second end 852 of the refining hearth 842. The outlet 848*a* can extend through the first sidewall 850*a*, and the outlet 858*b* can extend through the second, opposite sidewall 850*b*, for example. In various non-limiting embodiments, the edge 862*a*, 862*b* of each skull side 860*a*, 860*b* can be angularly oriented relative to the edge 862*a*, 862*b* of the central portion 860*a*. An angle $\theta_{7a}$, $\theta_{7b}$ can be defined between the edges 762*a*, 762*b* of the skull 860. For example, the angle $\theta_{7a}$ can be defined along the first portion 870*a* between the first side 860*a* of the skull 860 and the central portion 860*c* of the skull 880, and the angle $\theta_{7b}$ can be defined along the second portion 870*b* between the second side 860*b* of the skull 880 and the central portion 860*c* of the skull 880. Where the skull 860 is symmetrical, the angles $\theta_{7a}$, $\theta_{7b}$ at a selected location along the axis $X_7$ can be equal, for example. In various non-limiting embodiments, angles $\theta_{7a}$, $\theta_{7b}$ can be approximately 8 degrees, for example. In certain non-limiting embodiments, angles $\theta_{7a}$, $\theta_{7b}$ can be approximately 2 degrees to approximately 30 degrees, for example. In at least one non-limiting embodiment, angles $\theta_{7a}$, $\theta_{7b}$ can be less than 2 degrees, for example, and/or greater than 30 degrees, for example. In other words, the edges 862*a*, 862*b*, 862*c* of the skull 860 can taper and/or narrow along the bifurcated portions 870*a*, 870*b* of the flow path of molten material 870. In various non-limiting embodiments, the edges 862*a*, 862*b*, 862*c* of the skull 860 can continually taper along the bifurcated portions 870*a*, 870*b* of the flow path of molten material 870. Further, the edges 862*a*, 862*b*, 862*c* can be curved and/or straight between the inlet 846 and the outlet 848*a*, 848*b* and the degree of taper can vary along the length thereof. For example, a portion of the edges 862*a*, 862*b*, 862*c* can be curved/or and a portion of the edges 862*a*, 862*b*, 862*c* can be angled. Further, the curve or curves can have various radii of curvature, for example, and the angled portion or portions can be angled to various degrees, for example. As described herein, to maintain a constant or substantially constant mass flow through the tapered skull 860, for example, the velocity of the molten material flowing therethrough can increase between the inlet 846 and the outlets 848*a*, 848*b*.

Referring still to FIGS. 19-21, the inlet 846 can define an inlet cross-sectional area and the outlets 848*a*, 848*b* can define outlet cross-sectional areas. The total or sum of the outlet cross-sectional areas, i.e., the combined outlet cross-sectional area, can match or be similar to the inlet cross-sectional area, similar to the refining hearth 442 (FIGS. 8 and 9). In various non-limiting embodiments, the combined outlet cross-sectional area can be approximately 1% to approximately 5% different than the inlet cross-sectional area. In certain non-limiting embodiments, the combined outlet cross-sectional area can be less than approximately 1% different than the inlet cross-sectional area. In other non-limiting embodiments, the combined outlet cross-sectional area can be greater than approximately 5% different than the inlet cross-sectional area, and, for example, can be approximately 10% different than the inlet cross-sectional area. In various non-limiting embodiments, the inlet 846 can have an inlet width or diameter $A_7$, the first outlet 848*a* can have an outlet width or diameter $B_7$, and the second outlet 748*b* can have an outlet width or diameter $C_7$. In certain non-limiting embodiments, the sum of the outlet widths $B_7$ and $C_7$ can equal or substantially equal the inlet width $A_7$. For example, outlet widths $B_7$ and $C_7$ can be equal and can be 50% the length of inlet width $A_7$. In various non-limiting embodiments, additional or alternative dimensions can vary and/or match between the inlet 846 and the outlet 848, such that the inlet cross-sectional area matches the combined outlet cross-sectional area. In various non-limiting embodiments, the inlet cross-sectional area can correspond to an inlet capacity, and the outlet cross-sectional area can correspond to an outlet capacity. In certain non-limiting embodiments, the outlet capacity can match the inlet capacity, for example. In various non-limiting embodiments, the combined outlet cross-sectional area can be less than the inlet cross-sectional area. For example, the outlet cross-sectional area can be approximately 10% to approximately 50% less than the inlet cross-sectional area. In certain non-limiting embodiments, the difference can be less than approximately 10%, for example, or greater than approximately 50%, for example. In various non-limiting embodiments, the combined outlet capacity can be less than or greater than the inlet capacity, for example.

Various embodiments are described and illustrated in this specification to provide an overall understanding of the elements, steps, and use of the disclosed device and methods. It is understood that the various embodiments described and illustrated in this specification are non-limiting and non-exhaustive. Thus, the invention is not limited by the description of the various non-limiting and non-exhaustive embodiments disclosed in this specification. For example, though the non-limiting embodiments described above and illustrated in certain of the accompanying figures incorporate one or more electron beam guns, it will be understood that other melting power sources could be used in the casting systems as material heating devices. For example, the present disclosure also contemplates a casting system using one or more plasma generating devices that generate energetic plasma and heat metallic material within the casting system by contacting the material with the generated plasma. In appropriate circumstances, the features and characteristics described in connection with various embodiments may be combined, modified, or reorganized with the steps, components, elements, features, aspects, characteristics, limitations, and the like of other embodiments. Such modifications and variations are intended to be included within the scope of this specification. As such, the claims may be amended to recite any elements, steps, limitations, features, and/or characteristics expressly or inherently described in, or otherwise expressly or inherently supported by, this specification. Further, Applicants reserve the right to amend the claims to affirmatively disclaim elements, steps, limitations, features, and/or characteristics that are present in the prior art regardless of whether such features are explicitly described herein. Therefore, any such amendments comply with the requirements of 35 U.S.C. §112, first paragraph, and 35 U.S.C. §132(a). The various embodiments disclosed and described in this specification can comprise, consist of, or consist essentially of the steps, limitations, features, and/or characteristics as variously described herein.

Any patent, publication, or other disclosure material identified herein is incorporated by reference into this specification in its entirety unless otherwise indicated, but only to the extent that the incorporated material does not conflict with existing definitions, statements, or other disclosure material expressly set forth in this specification. As such, and to the extent necessary, the express disclosure as set forth in this specification supersedes any conflicting material incorporated by reference herein. Any material, or portion thereof, that is said to be incorporated by reference into this specification, but which conflicts with existing definitions, statements, or other disclosure material set forth herein, is only incorporated to the extent that no conflict arises between that incorporated material and the existing disclosure material. Applicants reserve the right to amend this specification to expressly recite any subject matter, or portion thereof, incorporated by reference herein.

The grammatical articles "one", "a", "an", and "the", if and as used in this specification, are intended to include "at least one" or "one or more", unless otherwise indicated. Thus, the articles are used in this specification to refer to one or more than one (i.e., to "at least one") of the grammatical objects of the article. By way of example, "a component" means one or more components, and thus, possibly, more than one component is contemplated and may be employed or used in an implementation of the described embodiments. Further, the use of a singular noun includes the plural, and the use of a plural noun includes the singular, unless the context of the usage requires otherwise.

As generally used herein, the terms "including" and "having" mean "comprising." As generally used herein, the term "approximately" and "substantially" refers to an acceptable degree of error for the quantity being measured, given the nature or precision of the measurement. Typical exemplary degrees may be within 20%, 10%, or 5% of a given value or range of values. All numerical quantities stated herein are to be understood as being modified in all instances by the term "approximately" unless otherwise indicated. The numerical quantities disclosed herein are approximate and each numerical value is intended to mean both the recited value and a functionally equivalent range surround that value. At the very least, and not as an attempt to limit the application of the doctrine of equivalents to the scope of the claims, each numerical value should at least be construed in light of the number of reported significant digits and by applying ordinary rounding techniques. Notwithstanding the approximations of numerical quantities stated herein, the numerical quantities described in specific examples of actual measured values are reported as accurately as possible.

All numerical ranges stated herein include all sub-ranges subsumed therein. For example, a range of "1 to 10" is intended to include all sub-ranges between and including the recited minimum value of 1 and the recited maximum value of 10. Any maximum numerical limitation recited herein is intended to include all lower numerical limitations. Any minimum numerical limitation herein is intended to include all higher numerical limitations.

In the above description, certain details are set forth to provide a thorough understanding of various embodiments of the articles and methods described herein. However, one of ordinary skill in the art will understand that the embodiments described herein may be practiced without these details. In other instances, well-known structures and methods associated with the articles and methods may not be shown or described in detail to avoid unnecessarily obscuring descriptions of the embodiments described herein. Also, this disclosure describes various features, aspects, and advantages of various embodiments of articles and methods. It is understood, however, that this disclosure embraces numerous alternative embodiments that may be accomplished by combining any of the various features, aspects, and advantages of the various embodiments described herein in any combination or sub-combination that one of ordinary skill in the art may find useful.

The invention claimed is:

1. A casting system, comprising:
a hearth, comprising:
an inlet defining an inlet cross-sectional area;
a plurality of outlets, wherein each outlet defines an outlet cross sectional area; and
a cavity between the inlet and the plurality of outlets, wherein the cavity tapers from the inlet toward the plurality of outlets; and
a plurality of molds, wherein a mold is aligned with each outlet of the hearth.

2. The casting system of claim 1, wherein the sum of the outlet cross sectional areas substantially matches the inlet cross-sectional area.

3. The casting system of claim 1, wherein the hearth comprises:
a first sidewall; and
a second sidewall, wherein the cavity is defined between the first sidewall and the second sidewall, and wherein the first sidewall is not parallel to the second sidewall.

4. The casting system of claim 3, wherein the first sidewall is angularly oriented approximately 1 degree to approximately 10 degrees relative to the second sidewall.

5. The casting system of claim 3, wherein the plurality of outlets comprises a first outlet and a second outlet, wherein the first outlet extends through the first sidewall, and wherein the second outlet extends through the second sidewall.

6. The casting system of claim 5, wherein the first outlet defines a first outlet cross-sectional area, wherein the second outlet defines a second outlet cross-sectional area, and wherein the second outlet cross-sectional area substantially matches the first outlet cross-sectional area.

7. The casting system of claim 1, wherein the cavity defines a longitudinal axis, and wherein the outlets are symmetrically arranged relative to the longitudinal axis.

8. The casting system of claim 1, wherein the molds are open-bottomed molds.

9. The casting system of claim 1, comprising an energy source, wherein the energy source is structured to energize material in the hearth, and wherein a portion of the material forms a solidified skull that defines the cavity in the hearth.

10. The casting system of claim 1, wherein each outlet comprises a pour lip, and wherein each pour lip is aligned with a mold of the casting system.

11. The casting system of claim 1, wherein the hearth comprises a fluid based cooling system.

12. The casting system of claim 1, wherein the plurality of molds are arranged for parallel casting.

13. A hearth for use with a casting system, wherein the hearth comprises:
a cavity, comprising:
a first end portion; and
a second end portion, wherein the cavity narrows between the first end portion and the second end portion;
an inlet at the first end portion, wherein the inlet defines an inlet capacity; and
an outlet at the second end portion, wherein the outlet defines an outlet capacity.

14. The hearth of claim 13, comprising:
a first sidewall; and
a second sidewall, wherein the cavity is defined between the first sidewall and the second sidewall, and wherein the first sidewall is angularly oriented relative to the second sidewall.

15. The hearth of claim 13, wherein the cavity tapers from approximately 1 degree to approximately 10 degrees between the first end portion and the second end portion.

16. The hearth of claim 15, wherein the cavity tapers approximately 4 degrees from the first end portion to the second end portion.

17. The hearth of claim 13, wherein the cavity comprises a skull of material, and wherein the skull of material defines the narrowing geometry between the first end portion and the second end portion.

18. The hearth of claim 13, wherein the outlet is a first outlet, wherein the hearth comprises a second outlet that defines an outlet capacity, wherein the sum of the outlet capacities of the first outlet and the second outlet substantially matches the inlet capacity.

19. The hearth of claim 18, wherein the cavity defines a longitudinal axis, and wherein the first outlet and the second outlet are symmetrically arranged relative to the longitudinal axis.

20. The hearth of claim 13, wherein the inlet comprises a low edge, wherein the outlet comprises a low edge, and wherein the low edge of the outlet is higher than the low edge of the inlet.

* * * * *